US005474882A

United States Patent [19]

Shono

[11] Patent Number: 5,474,882

[45] Date of Patent: Dec. 12, 1995

[54] SILVER HALIDE COLOR PHOTOGRAPHIC MATERIALS

[75] Inventor: Akiko Shono, Kanagawa, Japan

[73] Assignee: Fuji Photo Film Co., Ltd., Ashigara, Japan

[21] Appl. No.: 239,526

[22] Filed: May 9, 1994

Related U.S. Application Data

[62] Division of Ser. No. 797,908, Nov. 26, 1991, Pat. No. 5,332,655.

[30] Foreign Application Priority Data

Nov. 27, 1990 [JP] Japan ..... 2-324605
Nov. 27, 1990 [JP] Japan ..... 2-327613

[51] Int. Cl.[6] ..... G03C 7/388; G03C 7/396; G03C 7/392

[52] U.S. Cl. ..... 430/512; 430/545; 430/546; 430/551; 430/931

[58] Field of Search ..... 430/512, 551, 430/545, 931

[56] References Cited

U.S. PATENT DOCUMENTS

| | | | |
|---|---|---|---|
| 4,946,770 | 8/1990 | Takahashi et al. | 430/545 |
| 5,004,678 | 4/1991 | Seto et al. | 430/551 |
| 5,047,314 | 9/1991 | Sakai et al. | 430/551 |
| 5,049,482 | 9/1991 | Nishijima et al. | 430/551 |
| 5,057,408 | 10/1991 | Takahashi et al. | 430/551 |
| 5,104,781 | 4/1992 | Seto et al. | 430/551 |
| 5,132,202 | 7/1992 | Nishijima et al. | 430/551 |
| 5,178,991 | 1/1993 | Morigaki et al. | 430/551 |
| 5,212,055 | 5/1993 | Morigaki et al. | 430/551 |

*Primary Examiner*—Richard L. Schilling
*Attorney, Agent, or Firm*—Burns, Doane, Swecker & Mathis

[57] ABSTRACT

Disclosed is a silver halide color photographic material. The material comprises a support having thereon at least one photosensitive silver halide emulsion layer and at least one non-photosensitive hydrophilic colloid layer. A photosensitive silver halide emulsion layer or non-photosensitive hydrophilic colloid layer of the material comprises in the same layer a combination of (i) at least one water insoluble homopolymer or copolymer, (ii) at least one compound represented by formula (I) below, and (iii) at least one ultraviolet absorber:

(I)

6 Claims, No Drawings

SILVER HALIDE COLOR PHOTOGRAPHIC MATERIALS

This application is a divisional of application Ser. No. 07/797,908, filed Nov. 26, 1991, now U.S. Pat. No. 5,332, 655.

FIELD OF THE INVENTION

The invention relates to silver halide color photographic materials; particularly, silver halide color photographic materials having improved storage stabilities of their dye images.

BACKGROUND OF THE INVENTION

It is desirable that the dye image formed by the reaction of couplers with the oxidized form of a primary aromatic amine developing agent in a silver halide color photographic material, not fade on long term exposure to light, on short exposure to light, or upon storage for long periods of time in darkness.

Hence, in recent years ultraviolet absorbers have been added to sensitive materials in order to improve the fastness of the dye image to light. However, the light fastness of dye images formed from yellow, magenta and cyan couplers has still been found to be inadequate. There has been proposed a method in which the deterioration or elimination of the ultraviolet absorbers is prevented by dissolving the ultraviolet absorber in a high boiling point organic solvent such as phthalic acid esters and phosphoric acid esters. See JP-A-58-209735 (The term "JP-A" as used herein signifies an "unexamined published Japanese patent application"). The effect has been found to be inadequate.

A combination of benzophenone based ultraviolet absorbers and benzotriazole based ultraviolet absorbers has been suggested in JP-B-48-31255 and JP-B-48-30493, as another means of improving the light fastness of image dyes. (The term "JP-B" as used herein signifies an "examined Japanese patent publication".) However, the performance has been found to be inadequate because the ultraviolet absorbers themselves are broken down by light.

A method where a monomer latex is loaded with an ultraviolet absorber has been disclosed in British Patent 2,016,017A. But there is a disadvantage here in that a large quantity of polymer latex must be used relative to the amount of ultraviolet absorber in order to provide an adequate improvement in light fastness. Moreover, there are additional problems in that impurities such as emulsifying agents and unreacted monomer used during the preparation of the monomer latex and the polymerization inhibitor, have an degrading effect on the dyes.

A method in which an ultraviolet absorber monomer latex is used has also been disclosed in JP-A- 58-185677. But this technique only prevents the occurrence of yellow staining which is produced on the white base upon irradiation with light.

A method for improving the light fastness of both the ultraviolet absorbers themselves and the dye image by emulsification and dispersion of the ultraviolet absorber together with certain hydrophobic polymers is disclosed in JP-A-63-264748. However, satisfactory results have not been obtained. Other problems have been observed as well. Large amounts of monomer must be added relative to the amount of ultraviolet absorber in order to satisfactorily improve the light fastness of the ultraviolet absorber. As a result, a large dissolution time is required. Moreover, the mixed solution will have has a high viscosity making emulsification and dispersion difficult; coarse particles are easily produced causing coating failures.

SUMMARY OF THE INVENTION

Hence, an object of the present invention is to provide silver halide color photographic materials which exhibit little or no deterioration in photographic properties and in which coating failures will not occur, and in which the light fastness of the image dyes which have been formed from each coupler is improved.

It has been discovered that the above first object of the invention can be obtained by a silver halide color photographic material comprising a support, having thereon at least one photosensitive silver halide emulsion layer and at least one non-photosensitive hydrophilic colloid layer. At least one of the emulsion layer(s) or hydrophilic colloid layer(s) contain (i) at least one type of water insoluble homopolymer or copolymer, (ii) at least one type of compound represented by general formula (I), and (iii) at least one type of ultraviolet absorber, wherein components (i), (ii) and (iii) are included in the same layer.

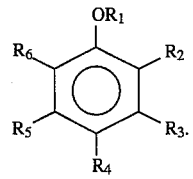

(I)

In the above formula, $R_1$ represents an alkyl group, an alkenyl group, an aryl group, a heterocyclic group, a silyl group, an acyl group or a sulfonyl group. $R_2$, $R_3$, $R_4$, $R_5$, and $R_6$, which may be the same or different, each represent a hydrogen atom, an alkyl group, an alkenyl group, an aryl group, a substituted amino group, an alkylthio group, an arylthio group, a halogen atom, $$-\overset{\overset{\displaystyle O}{\|}}{C}-OR_{1a} \text{ or } -OR_{1a},$$

where $R_{1a}$ has the same significance as $R_1$. $R_1$ and $R_2$, $R_2$ and $R_3$, or $R_3$ and $R_4$ may be joined together to form a five or six membered ring or a spiro ring. Said alkyl group, alkoxy group and alkyl moiety of the groups represented by $R_1$ to $R_6$ preferably each has 1 to 25, more preferably 1 to 20 carbon atoms.

Another object of the invention is to provide silver halide color photographic materials where the light fastness of the dye image which has been formed from each coupler is improved.

Even another objects to provide silver halide color photographic materials where there is a significant suppression of staining due to light in the so-called white base where no color has been formed.

A further object is to provide silver halide color photographic materials with improved stability with respect to light of the ultraviolet absorbers themselves.

Another object is to provide silver halide color photographic materials having improved fading properties (the fading being due to light of the dye image formed from each coupler) without worsening other photographic properties such as the progress of development.

It has been discovered that these other objects (objects 2–5) can be obtained by a silver halide color photographic material comprising a support, having thereon at least one photosensitive silver halide emulsion layer and at least one non-photosensitive hydrophilic colloid layer. At least one of the emulsion layer(s) or hydrophilic colloid layer(s) contain (i) at least one type of compound represented by general formula (I-i), and (ii) at least one type of ultraviolet absorber, wherein components (i), (ii) and (iii) are included in the same layer.

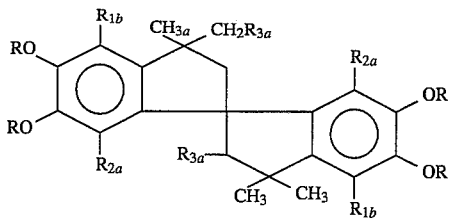

In the above formula (I-i) above, the R groups may be the same or different, and each represents an alkyl group, an alkenyl group, an aryl group, a heterocyclic group, an $R_{4a}CO$— group, and $R_{5a}SO_2$— group or an $R_{6a}NHCO$— group; $R_{1b}$ and $R_{2a}$ each represent a hydrogen atom, a halogen atom, an alkyl group, an alkenyl group, an alkoxy group or an alkenoxy group; $R_{3a}$ represents a hydrogen atom, an alkyl group, an alkenyl group or an aryl group; and $R_{4a}$, $R_{5a}$ and $R_{6a}$ each represent an alkyl group, an alkenyl group, an aryl group or a heterocyclic group.

Compounds represented by general formula (II) below are preferred as ultraviolet absorbers useful in this present invention.

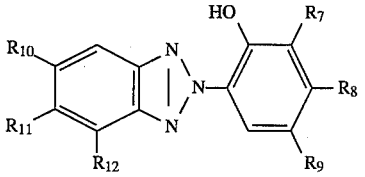

In formula (II), $R_7$, $R_8$, $R_9$, $R_{10}$, $R_{11}$ and $R_{12}$ each represent a hydrogen atom, a halogen atom, a nitro group, a hydroxy group, an alkyl group, an alkoxy group, an aryl group, an aryloxy group, an acylamino group, a carbamoyl group or a sulfo group. $R_{11}$ and $R_{12}$ may be joined together to form a six membered ring. Said alkyl and alkoxy groups represented by $R_7$ to $R_9$ preferably each has 1 to 20 carbon atoms, and more preferably not more than 20 in total of each group, whereas those groups represented by $R_{10}$ to $R_{12}$ preferably each has 1 to 5 carbon atoms.

According to a preferred embodiment, a non-photosensitive hydrophilic colloid layer contains (i) at least one type of water insoluble homopolymer or copolymer, (ii) at least one type of compound represented by formula (i), and (iii) at least one type of ultraviolet absorber. More preferably, one or more photosensitive silver halide emulsion layer(s) and one or more non-photosensitive hydrophilic colloid layer(s) and those contain (i) at least one type of water insoluble homopolymer or copolymer, (ii) at least one type of compound represented by general formula (I), and (iii) at least one type of ultraviolet absorber. It is another preferred embodiment where the aforementioned photosensitive layer(s) and/or non-photosensitive hydrophilic colloid layer(s) contain a dispersion obtained by the emulsification and dispersion of a mixed solvent in which at least one type of water insoluble but organic solvent soluble homopolymer or copolymer, and at least one type of compound represented by general formula (I) have been dissolved.

DETAILED DESCRIPTION OF THE INVENTION

Examples of suitable water insoluble polymers useful in the present invention are described in detail below.

(A) Vinyl Polymers

Monomers which can form vinyl polymers useful in the present invention include acrylic acid esters, for example methyl acrylate, ethyl acrylate, n-propyl acrylate, iso-propyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxy-polyethyleneglycol acrylate (number of mol added n=9), 1-bromo-2-methoxyethyl acrylate and 1,1-dichloro-2-ethoxyethyl acrylate.

The following monomers can also be used to form vinyl polymers useful in the present invention. N-propyl methacrylate, iso-propyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyl-eneglycol methacrylate, (number of mol added n=6), allyl methacrylate, and the dimethylaminoethylmethyl chloride salt of methacrylic acid.

Also useful are vinyl esters. Examples include vinyl acetate, vinyl propionate, vinyl butyrate, vinyl iso-butyrate, vinyl caproate, vinyl chloroacetate, vinyl methoxyacetate, vinyl phenylacetate, vinyl benzoate and vinyl salicylate.

Acrylamides are also useful. Examples include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethyl-acrylamide, N-(2-acetoacetoxyethyl)acrylamide, diacetone-acrylamide and tert-octylacrylamide.

Methacrylamides are useful and examples include methacrylamide, methylmethacrylamide, ethylmethacrylamide, propyl-methacrylamide, butylmethacrylamide, tert-butylmethacrylamide, cyclohexylmethacrylamide, benzyl-methacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide.

Olefins can be used to provide a suitable polymer. Examples include dicyclopentadiene, ethylene, propylene, 1-butene, 1-pentene, vinyl chloride, vinylidene chloride, isoprene, chloroprene, butadiene and 2,3-dimethylbutadine; styrenes, for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and the methyl ester of vinyl benzoic acid.

Also vinyl ethers are useful such as methyl vinyl ether, butyl vinyl ether, hexyl vinyl ether, methoxyethyl vinyl ether and dimethylaminoethyl vinyl ether.

Other useful monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, vinylidene chloride, methylenemalonitrile and vinylidene.

Two or more of the above mentioned monomers can be used together as co-monomers in polymers useful in the present invention for various purposes (e.g., improving solubility). Monomers which have acid groups can also be used as co-monomers for solubility adjustment purposes within a range such that the co-polymer does not become water soluble. Examples of such include acrylic acid; methacrylic acid; itaconic acid; maleic acid; monoalkyl itaconates such as monomethyl itaconate, monoethyl itaconate and monobutyl itaconate; monoalkyl maleates such as monomethyl maleate, monoethyl maleate and monobutyl maleate; citraconic acid; styrenesulfonic acid; vinylbenzylsulfonic acid; vinylsulfonic acid; acryloyloxyalkyl-sulfonic acids such as acryloyloxymethylsulfonic acid, acryloyloxyethylsulfonic acid and acryloyloxypropylsulfonic acid; methacryloyloxyalkylsulfonic acids such as methacryloyloxymethylsulfonic acid, methacryloyloxyethyl-sulfonic acid and methacryloyloxypropylsulfonic acid; acrylamidoalkylsulfonic acids such as 2-acrylamido-2-methylethanesulfonic acid, 2-acrylamido-2-methylpropanesulfonic acid and 2-acrylamido-2-methylbutanesulfonic acid; and methacrylamidoalkylsulfonic acids such as 2-methacrylamido-2-methylethanesulfonic acid, 2-methacrylamido-2-methylpropanesulfonic acid and 2-methacrylamido-2-methylbutanesulfonic acid; and these acids may take the form of their alkali metal (for example Na, K) or ammonium ion salts.

The hydrophilic vinyl monomers above and other hydrophilic vinyl monomers (referred to herein as monomers of which their homopolymers are water soluble) may be used as co-monomers provided that the copolymer does not become water soluble, No particular limitation is imposed upon the proportion of hydrophilic monomer in the copolymer. However, generally the proportion will preferably be not more than 40 mol %, more preferably not more than 20 mol %, and most preferably not more that 10 mol %.

The polymers of this present invention preferably have a —CO— bond or a phenyl group in the repeating unit, and methacrylate based, acrylate based and styrene based polymers are the most desirable.

In general copolymers obtained by the copolymerization of two or more monomers are preferred, and copolymers of methacrylate based, acrylate based and styrene based monomers with other monomers such as those indicated above are especially desirable. Of course, two or more types of copolymers can be used together.

(B) Polyester Resins Obtained by the Condensation of Poly-hydric Alcohols and Poly-basic Acids Other suitable polymers include polyester resins obtained by the copolymerization of polyhydric alcohols and polybasic acids. Glycols which have an HO—$R_1$—OH structure, where $R_1$ is a hydrocarbon chain, especially an aliphatic hydrocarbon chain, which has from 2 to about 12 carbon atoms, or polyalkylene glycols, are effective as polyhydric alcohols, and dibasic acids which have an HOOC—$R_2$—COOH structure where $R_2$ may represent a single bond or a hydrocarbon chain which has from 1 to about 12 carbon atoms, are effective as the poly-basic acids.

Actual examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythritol, mannitol and sorbitol.

Actual examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, iso-phthalic acid, terephthalic acid, tetrachlorophthalic acid, metaconic acid, isopimelic acid, cyclopentadiene-maleic anhydride adduct and rosin-maleic acid adduct.

(C) Others

Other polymers are suitable as well. For example, polyesters obtained by means of ring opening polymerization. Such polyesters have the repeating unit shown on the right below.

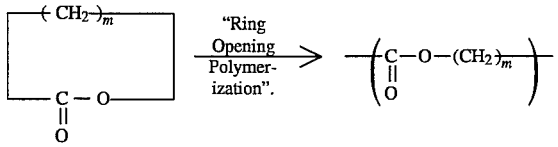

In the above mechanism m represents an integer of value from 4 to 7. Moreover, the —$CH_2$— chains may be branched.

Appropriate monomers which can be used to prepare the polyesters include β-propiolactone, ε-caprolactone and dimethylpropiolactone.

The polymers which are used most preferably according to the present invention are polymers which are insoluble in water but soluble in organic solvents, and which include a repeating unit which has a —CO— bond or a phenyl group within the molecule in the main chain or in a side chain. Here, the organic solvent is preferably an auxiliary solvent or a high boiling point organic solvent which is preferably and used in the emulsification and dispersion procedure described above and in further detail below.

Some actual examples of polymers which can be used according to the invention are set forth below, but the invention should not be construed as limited by these examples.

The proportions in parenthesis below indicate mol ratios.

Polymer

P-1) Poly(vinyl acetate)

P-2) Poly(vinyl propionate)
P-3) Poly(methyl methacrylate)
P-4) Poly(ethyl methacrylate)
P-5) Poly(ethyl acrylate)
P-6) Vinyl acetate/vinyl alcohol copolymer (95:5)
P-7) Poly(n-butyl acrylate)
P-8) Poly(n-butyl methacrylate)
P-9) Poly(isobutyl methacrylate)
P-10) Poly(isopropyl methacrylate)
P-11) Poly(decyl methacrylate)
P-12) Butyl acrylate/acrylamide copolymer (95:5)
P-13) Poly(chloromethyl acrylate)
P-14) 1,4-Butanediol/adipic acid polyester
P-15) Ethylene glycol/sebacic acid polyester
P-16) Polycaprolactone
P-17) Poly(2-tert-butylphenyl acrylate)
P-18) Poly(4-tert-butylphenyl acrylate)
P-19) n-Butyl methacrylate/N-vinyl-2-pyrrolidone copolymer (90:10)
P-20) Methyl methacrylate/vinyl chloride copolymer (70:30)
P-21) Methyl methacrylate/styrene copolymer (90:10)
P-22) Methyl methacrylate/ethyl acrylate copolymer (50:50)
P-23) n-Butyl methacrylate/methyl methacrylate/styrene copolymer (50:30:20)
P-24) Vinyl acetate/acrylamide copolymer (85:15)
P-25) Vinyl chloride/vinyl acetate copolymer (65:35)
P-26) Methyl methacrylate/acrylonitrile copolymer (65:35)
P-27) Diacetoneacrylamide/methyl methacrylate copolymer (50:50)
P-28) Vinyl methyl ketone/isobutyl methacrylate copolymer (55:45)
P-29) Ethyl methacrylate/n-butyl acrylate copolymer (70:30)
P-30) Diacetoneacrylamide/n-butyl acrylate copolymer (60:40)
P-31) Methyl methacrylate/cyclohexyl methacrylate copolymer (50:50)
P-32) n-Butyl acrylate/styrene methacrylate/diacetoneacrylamide copolymer (sic) (70:20:10)
P-33) N-Tert-butylacrylamide/methyl methacrylate/acrylic acid copolymer (60:30:10)
P-34) Methyl methacrylate/styrene/vinylsulfonamide copolymer (70:20:10)
P-35) Methyl methacrylate/phenyl vinyl ketone copolymer (70:30)
P-36) n-Butyl acrylate/methyl methacrylate/n-butyl methacrylate copolymer (35:35:30)
P-37) n-Butyl acrylate/pentyl methacrylate/N-vinyl-2-pyrrolidone copolymer (38:38:24)
P-38) Methyl methacrylate/n-butyl methacrylate/isobutyl methacrylate/acrylic acid copolymer (37:29:25:9)
P-39) n-Butyl methacrylate/acrylic acid copolymer (95:5)
P-40) Methyl methacrylate/acrylic acid copolymer (95:5)
P-41) Benzyl methacrylate/acrylic acid copolymer (90:10)
P-42) n-Butyl methacrylate/methyl methacrylate/benzyl methacrylate/acrylic acid copolymer (35:35:25:5)
P-43) n-Butyl methacrylate/methyl methacrylate/benzyl methacrylate copolymer (35:35:30)
P-44) Poly(3-pentyl acrylate)
P-45) Cyclohexyl methacrylate/methyl methacrylate/n-propyl methacrylate copolymer (37:29:34)
P-46) Poly(pentyl methacrylate)
P-47) Methyl methacrylate/n-butyl methacrylate copolymer (65:35)
P-48) Vinyl acetate/vinyl propionate copolymer (75:25)
P-49) n-Butyl methacrylate/3-acryloxybutane-1-sulfonic acid, sodium salt, copolymer (97:3)
P-50) n-Butyl methacrylate/methyl methacrylate/acrylamide copolymer (35:35:30)
P-51) n-Butyl methacrylate/methyl methacrylate/vinyl chloride copolymer (37:36:27)
P-52) n-Butyl methacrylate/styrene copolymer (90:10)
P-53) Methyl methacrylate/N-vinyl-2-pyrrolidone copolymer (90:10)
P-54) n-Butyl methacrylate/vinyl chloride copolymer (90:10)
P-55) n-Butyl methacrylate/styrene copolymer (70:30)
P-56) Poly(N-sec-butylacrylamide)
P-57) Poly(N-tert-butylacrylamide)
P-58) Diacetoneacrylamide/methyl methacrylate copolymer (62:38)
P-59) Cyclohexyl methacrylate/methyl acrylate copolymer (60:40)
P-60) N-Tert-butylacrylamide/methyl methacrylate copolymer (40:60)
P-61) Poly (N-n-butylacrylamide)
P-62) Tert-butyl methacrylate/N-tert-butylacrylamide copolymer (50:50)
P-63) Tert-butyl methacrylate/methyl methacrylate copolymer (70:30)
P-64) Poly(N-tert-butylmethacrylamide)
P-65) N-Tert-butylacrylamide/methyl methacrylate copolymer (60:40)
P-66) Methyl methacrylate/acrylonitrile copolymer (70:30)
P-67) Methyl methacrylate/vinyl methyl ketone copolymer (38:62)
P-68) Methyl methacrylate/styrene copolymer (50:50)
P-69) Methyl methacrylate/hexyl methacrylate copolymer (70:30)
P-70) Poly(benzyl acrylate)
P-71) Poly(4-biphenyl acrylate)
P-72) Poly(4-butoxycarbonylphenyl acrylate)
P-73) Poly(sec-butyl acrylate)
P-74) Poly(tert-butyl acrylate)
P-75) Poly(3-chloro-2,2-(chloromethyl)propyl acrylate)
P-76) Poly(2-chlorophenyl acrylate)
P-77) Poly(4-chlorophenyl acrylate)
P-78) Poly(pentachlorophenyl acrylate)
P-79) Poly(4-cyanobenzyl acrylate)
P-80) tert-butylacrylamide/styrene copolymer (55:45)
P-81) n-Butyl acrylate/styrene copolymer (50:50)
P-82) Poly(cyanoethyl acrylate)
P-83) Poly(4-cyanophenyl acrylate)
P-84) Poly(4-cyano-3-thiabutyl acrylate)
P-85) Poly(cyclohexyl acrylate)
P-86) Poly(2-ethoxycarbonylphenyl acrylate)
P-87) Poly(3-ethoxycarbonylphenyl acrylate)
P-88) Poly(4-ethoxycarbonylphenyl acrylate)
P-89) Poly(2-ethoxyethyl acrylate)
P-90) Poly(3-ethoxypropyl acrylate)
P-91) Poly(1H,1H,5H-octafluoropentyl acrylate)
P-92) Poly(heptyl acrylate)
P-93) Ply(hexadecyl acrylate)
P-94) Poly(hexyl acrylate)
P-95) Poly(isobutyl acrylate)
P-96) Poly(isopropyl acrylate)
P-97) Ply(3-methoxybutyl acrylate)
P-98) Poly(2-methoxycarbonylphenyl acrylate)
P-99) Poly(3-methoxycarbonylphenyl acrylate)
P-100) Poly(4-methoxycarbonylphenyl acrylate)
P-101) Poly(2-methoxyethyl acrylate)
P-102) Poly(4-methoxyphenyl acrylate)
P-103) Poly(3-methoxypropyl acrylate)
P-104) Poly(3,5-dimethyladamantyl acrylate)

P-105) Poly(3-dimethylaminophenyl acrylate)
P-106) Poly(vinyl tert-butyrate)
P-107) Poly(2-methylbutyl acrylate)
P-108) Poly(3-methylbutyl acrylate)
P-109) Poly(1,3-dimethylbutyl acrylate)
P-11O) Poly(2-methylpentyl acrylate)
P-111) Poly(2-naphthyl acrylate)
P-112) Poly(phenyl acrylate)
P-113) Poly(propyl acrylate)
P-114) Poly(m-tolyl acrylate)
P-115) Poly(o-tolyl acrylate)
P-116) Poly(p-tolyl acrylate)
P-117) Poly(N,N-dibutylacrylamide)
P-118) Poly(isohexylacrylamide)
P-119) Poly(iso-octylacrylamide)
P-120) Poly(cyclohexylacrylamide)
P-121) Poly(N-methyl-N-phenylacrylamide)
P-122) Poly(adamantyl methacrylate)
P-123) Poly(benzyl methacrylate)
P-124) Poly(2-bromoethyl methacrylate)
P-125) Poly(2-N-tert-butylaminoethyl methacrylate)
P-126) Poly(sec-butyl methacrylate)
P-127) Poly(tert-butyl methacrylate)
P-128) Poly(2-chloroethyl methacrylate)
P-129) Poly(2-cyanoethyl methacrylate)
P-130) Poly(2-cyanomethylphenyl methacrylate)
P-131) Poly(4-cyanophenyl methacrylate)
P-132) Poly(cyclohexyl methacrylate)
P-133) Poly(dodecyl methacrylate)
P-134) Poly(diethylaminoethyl methacrylate)
P-135) Poly(2-ethylsulfinylethyl methacrylate)
P-136) Poly(hexadecyl methacrylate)
P-137) Poly(hexyl methacrylate)
P-138) Poly(2-hydroxypropyl methacrylate)
P-139) Poly(4-methoxycarbonylphenyl methacrylate)
P-140) Poly(3,5-dimethyladamantyl methacrylate)
P-141) Poly(dimethylaminoethyl methacrylate)
P-142) Poly(3,3-dimethylbutyl methacrylate)
P-143) Poly(3,3-dimethyl-2-butyl methacrylate)
P-144) Poly(3,5,5-trimethylhexyl methacrylate)
P-145) Poly(octadecyl methacrylate)
P-146) Poly(tetradecyl methacrylate)
P-147) Poly(4-butoxycarbonylphenylmethacrylamide)
P-148) Poly(4-carboxyphenylmethacrylamide)
P-149) Poly(4-ethoxycarbonylphenylmethacrylamide)
P-150) Poly(4-methoxycarbonylphenylmethacrylamide)
P-151) Poly(butylbutoxycarbonyl methacrylate)
P-152) Poly(butyl chloroacrylate)
P-153) Poly(butyl cyanoacrylate)
P-154) Poly(cyclohexyl chloroacrylate)
P-155) Poly(ethyl chloroacrylate)
P-156) Poly(ethyl ethoxycarbonylmethacrylate)
P-157) Poly(ethyl ethacrylate)
P-158) Poly(ethyl fluoromethacrylate)
P-159) Poly(hexyl hexyloxycarbonylmethacrylate)
P-160) Poly(isobutyl chloroacrylate)
P-161) Poly(isopropyl chloroacrylate)
P-162) Poly(tert-butylstyrene)

In the compounds of general formula (I) $R_1$ represents an alkyl group such as methyl, n-butyl, n-octyl, n-hexadecyl, ethoxymethyl, or 3-phenoxypropyl, benzyl, an alkenyl group such as vinyl, and allyl, an aryl group such as phenyl, and naphthyl, a heterocyclic group such as pyridyl, and tetrahydropyranyl, a silyl group such as trimethylsilyl, tert-butyl dimethyl silyl, an acyl group such as acetyl, benzoyl, and dodeconoyl, or a sulfonyl group such as methanesulfonyl, octanesulfonyl, and benzenesulfonyl. $R_2$, $R_3$, $R_4$, $R_5$ and $R_6$ which may be the same or different, each represent a hydrogen atom, an alkyl group such as methyl, n-butyl, n-octyl, sec-dodecyl, tert-butyl, tert-amyl, tert-hexyl, tert-octyl, tert-octadecyl, α,α-dimethylbenzyl, and 1,1-dimethyl-4-hexyloxycarbonylbutyl, an alkenyl group such as vinyl, and allyl, an aryl group such as phenyl, naphthyl, p-methoxyphenyl, and 2,4-tert-butylphenyl, a substituted amino group such as acetylamino, propionylamino, benzamido, N-methylamino, N,N-dimethylamino, N,N-dihexylamino, N-cyclohexylamino, such as N-(tert-butyl)amino, a nitrogen containing heterocyclic group on which the substituent groups form a closed ring such as piperidino, and 1-piperazinyl, an alkylthio group such as methylthio, n-butylthio, secbutylthio, tert-butylthio, and dodecylthio, a halogen atom such as chlorine, and bromine), $$-\underset{\underset{O}{\|}}{C}-OR_{1a}$$

groups such as octyloxy-carbonyl, and 2,4-di-tert-butylphenoxycarbonyl or —O—$R_{1a}$. Here, $R_{1a}$ is the same as $R_1$. $R_1$ and $R_2$ may be joined together to form a five or six membered ring or a spiro ring. $R_2$ and $R_3$ or $R_3$ and $R_4$ may be joined together to form a five or six membered ring or a spiro ring. Such rings may be, for example, be chroman rings, coumaran rings, spirochroman rings or spiroindane rings.

Those of the compounds of formula (I) represented by the general formulae (I-a) to (I-h) below are especially preferred.

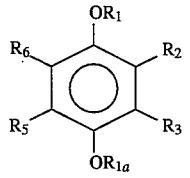

(I-a)

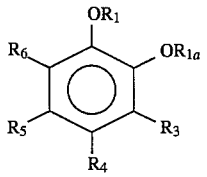

(I-b)

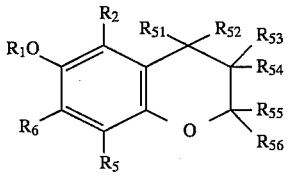

(I-c)

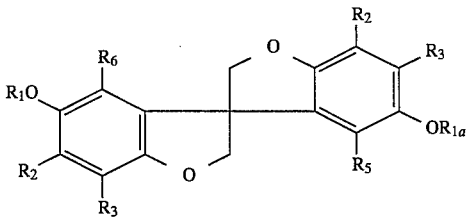

(I-d)

-continued (I-e)

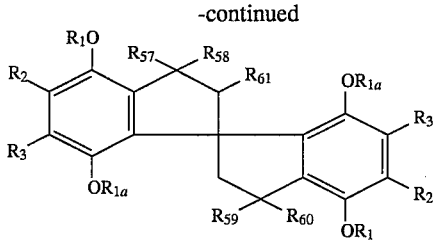

(I-f)

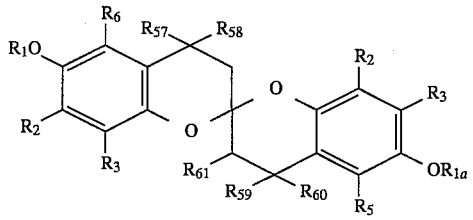

(I-g)

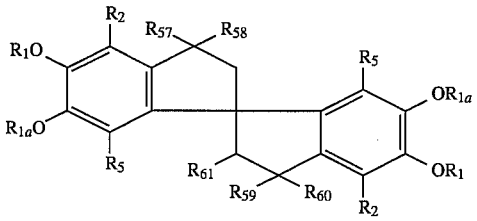

(I-h)

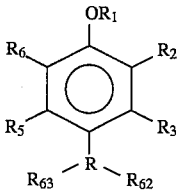

In general formulae (I-a) to (I-h), $R_1$, $R_{1a}$, $R_2$, $R_3$, $R_4$, $R_5$ and $R_6$ represent the same groups described above in connection with formula (I). $R_{51}$ to $R_{61}$ may be the same or different, and each represent a hydrogen atom, an alkyl group such as methyl, ethyl, isopropyl, and dodecyl, or an aryl group such as phenyl and p-methoxyphenyl. $R_{54}$ and $R_{55}$, and $R_{55}$ and $R_{56}$, may be joined together to form a five to seven membered hydrocarbyl ring.

$R_{62}$ and $R_{63}$ may be the same or different, and each represent a hydrogen atom, an alkyl group such as methyl, ethyl, and dodecyl, an aryl group such as phenyl, and 4-chlorophenyl, an acyl group such as acetyl, benzoyl, and dodecanoyl, an oxycarbonyl group such as methoxycarbonyl, and 4-dodecyloxyphenoxycarbonyl or a sulfonyl group such as methanesulfonyl, octanesulfonyl, and benzenesulfonyl. However, $R_{62}$ and $R_{63}$ cannot both be hydrogen atoms at the same time. Furthermore, $R_{62}$ and $R_{63}$ may be joined together to form a five to seven membered ring such as a morpholine ring or a piperidine ring.

Those compounds represented by general formulae (I-a) to (I-h) in which $R_1$ and $R_{1a}$ each represent an alkyl group or an aryl group are preferred, and those in which those groups are alkyl groups are the most desirable. Furthermore, those compounds represented by general formulae (I-a) to (I-h) in which $R_2$ to $R_6$ are hydrogen atoms, alkyl groups or aryl groups are preferred.

Of the compounds represented by the general formulae (I-a) to (I-h) those represented by the general formulae (I-a), (I-c), (I-e), (I-f) and (I-g) are preferred, and the compounds represented by general formula (I-g) are the most desirable.

Actual examples of compounds which are represented by formula (I) are set forth below, but the invention should not be construed as limited by these examples.

I-1

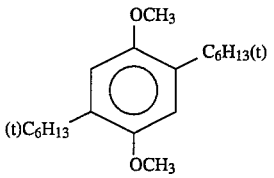

I-2

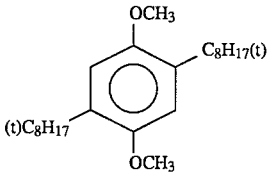

I-3

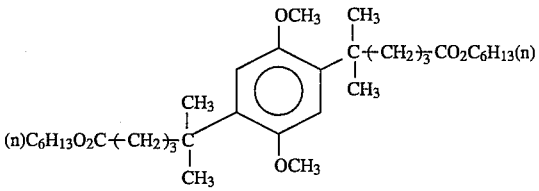

-continued
I-4
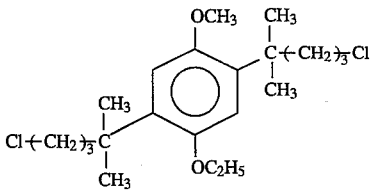
I-5
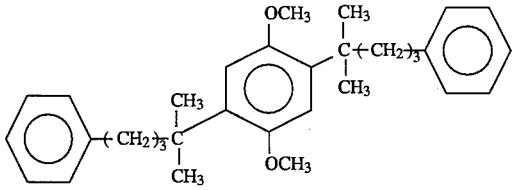
I-6
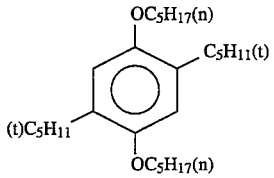
I-7
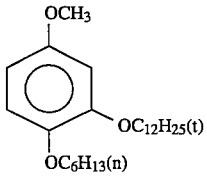
I-8
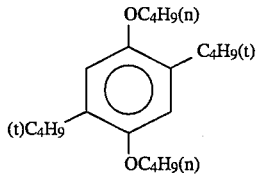
I-9
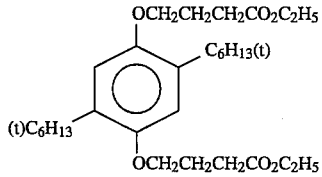
I-10
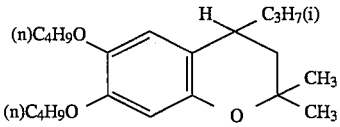
I-11
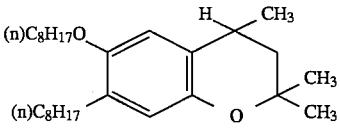
I-12
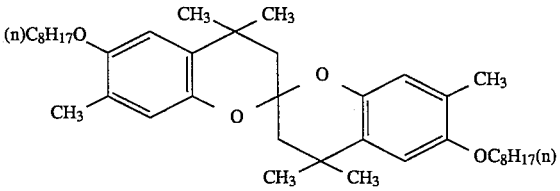

-continued
I-13
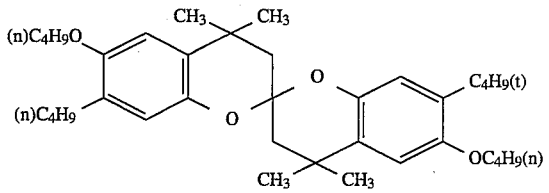
I-14
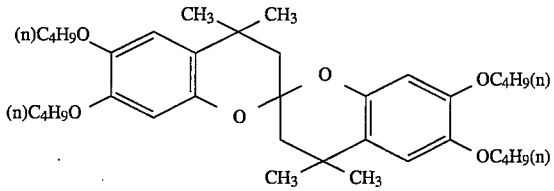
I-15
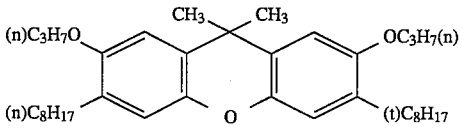
I-16
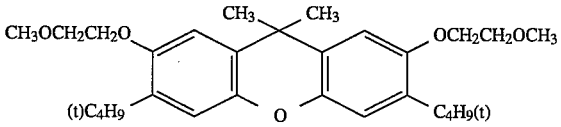
I-17
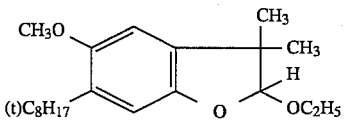
I-18
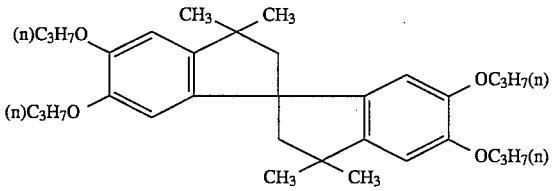
I-19
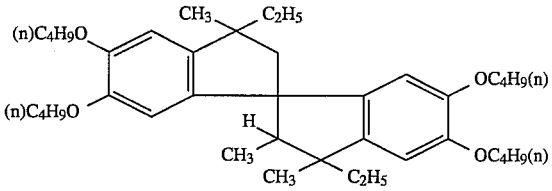
I-20
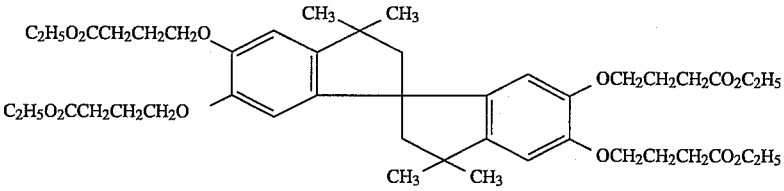
I-21
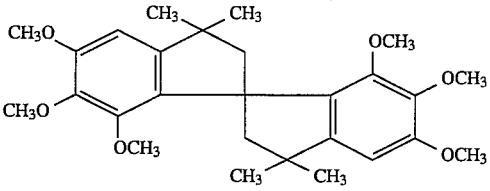

-continued
I-22
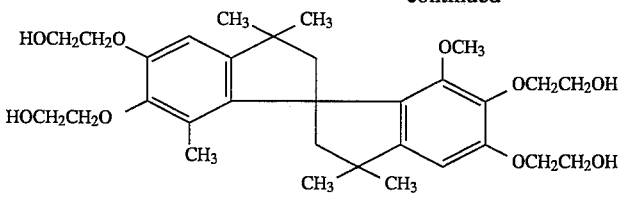
I-23
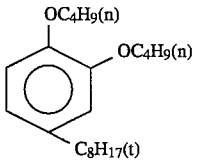
I-24
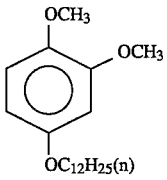
I-25
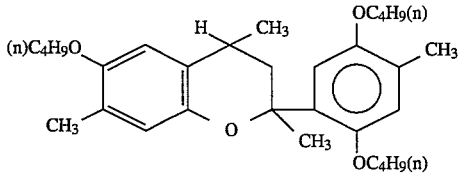
I-26
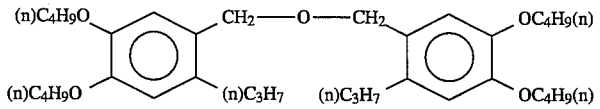
I-27
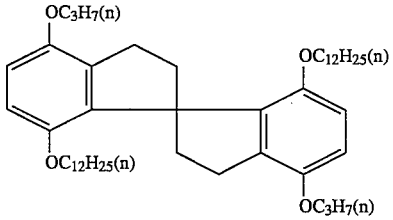
I-28
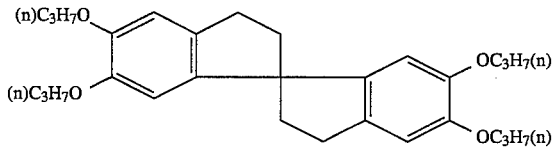
I-29
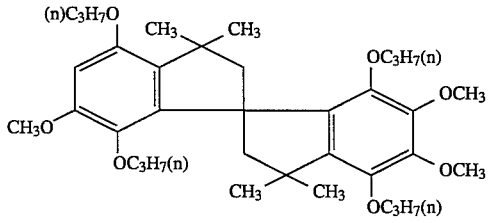
I-30
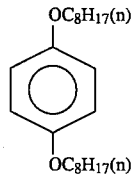

-continued
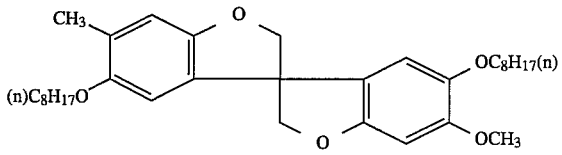
I-31
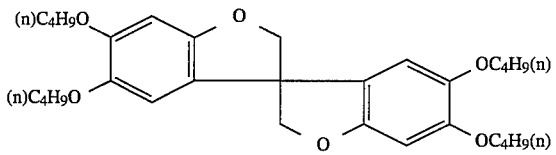
I-32
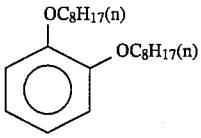
I-33
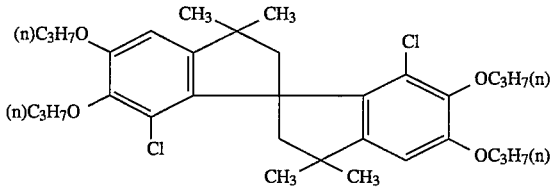
I-34
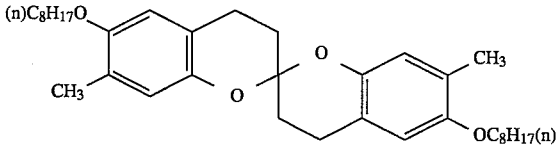
I-35
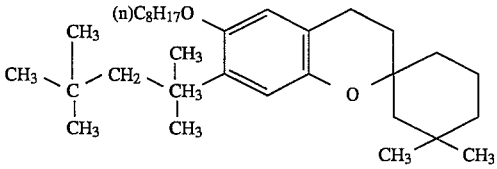
I-36
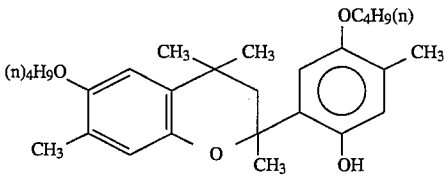
I-37
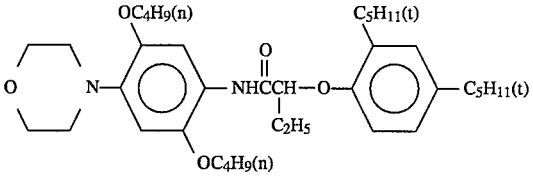
I-38
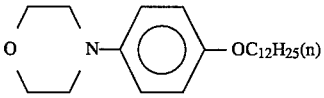
I-39
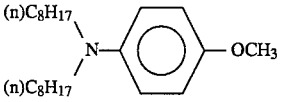
I-40

-continued
I-41
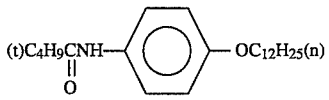
I-42
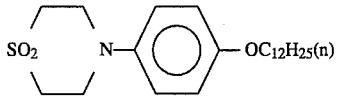
I-43
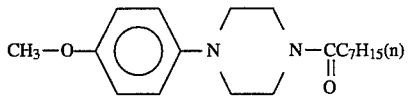
I-44
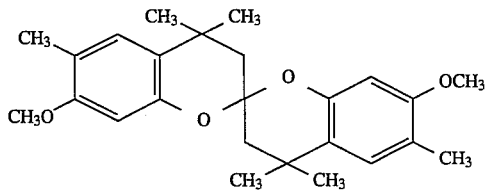
I-45
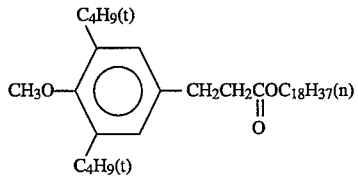
I-46
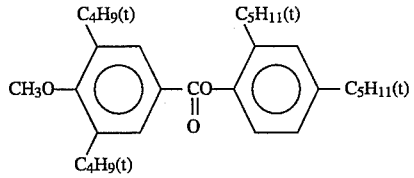
I-47
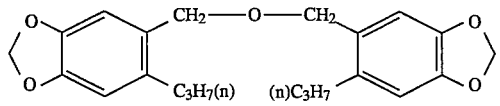
I-48
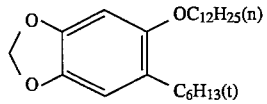
Actual examples of compounds represented by general formula (I-i) which are effective for the realization of all five objects of the invention described above, are set forth below.
(I-i-1)
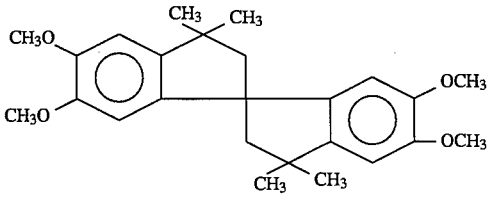
(I-i-2)
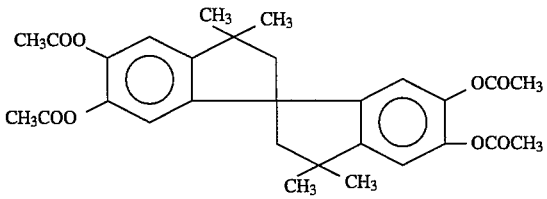

-continued
(I-i-3)
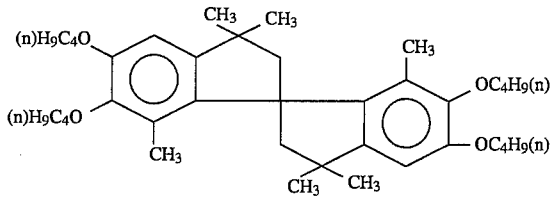
(I-i-4)
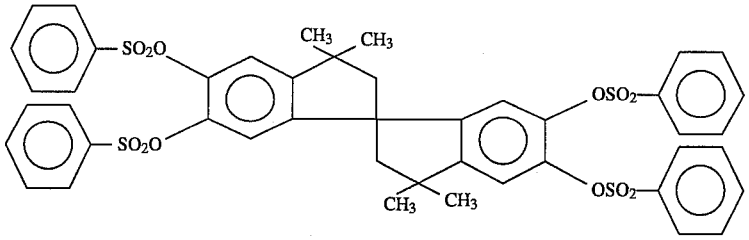
(I-i-5)
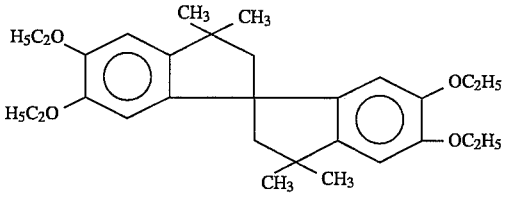
(I-i-6)
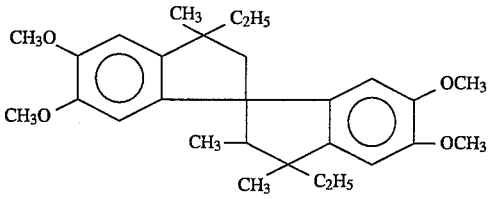
(I-i-7)
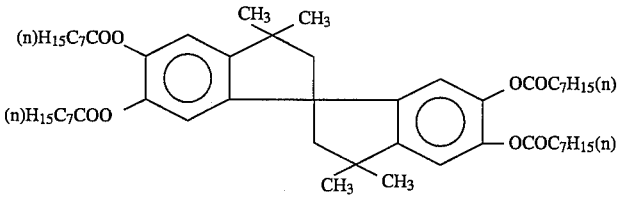
(I-i-8)
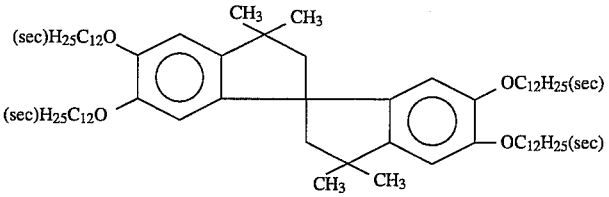
(I-i-9)
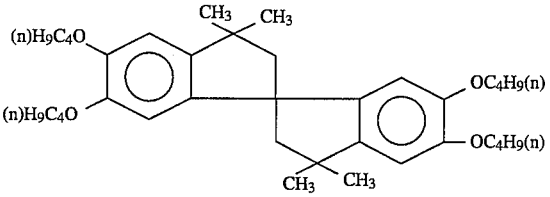

-continued
(I-i-10)
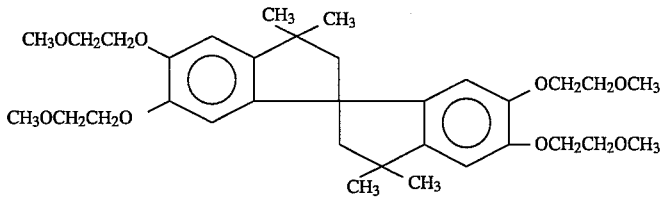
(I-i-11)
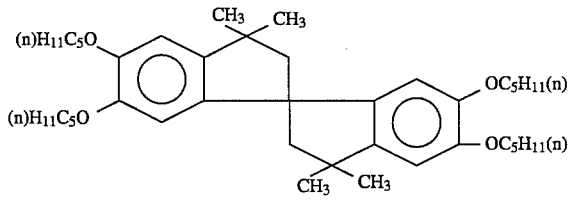
(I-i-12)
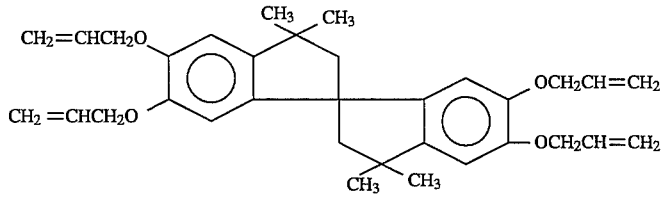
(I-i-13)
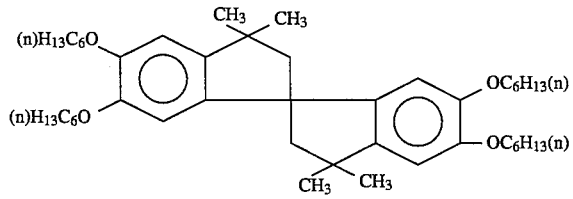
(I-i-14)
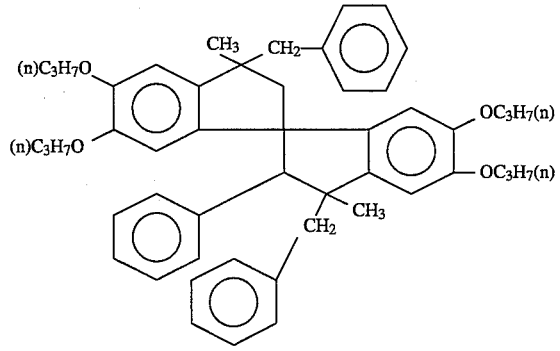
(I-i-15)
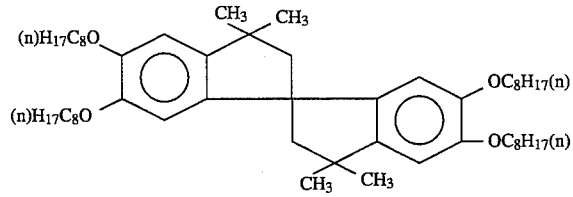
(I-i-16)
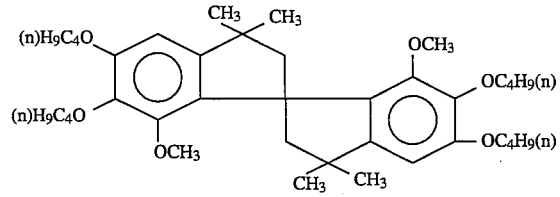

-continued
(I-i-17)
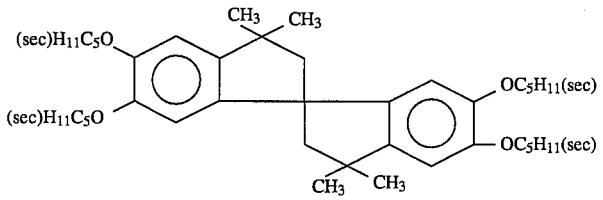
(I-i-18)
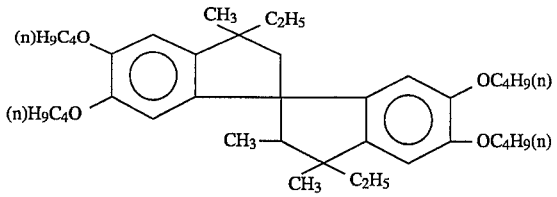
(I-i-19)
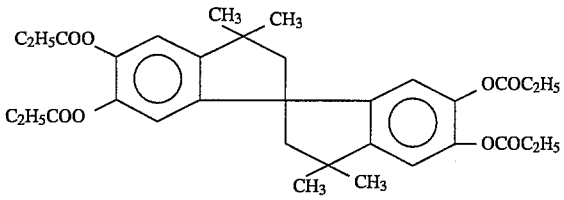
(I-i-20)
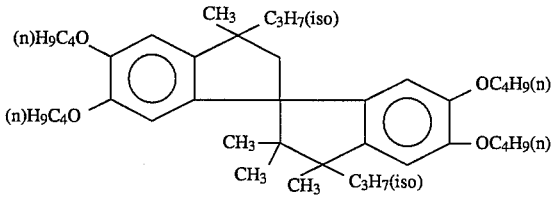
(I-i-21)
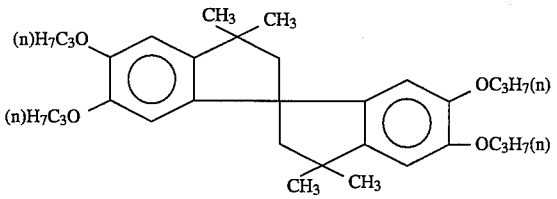
(I-i-22)
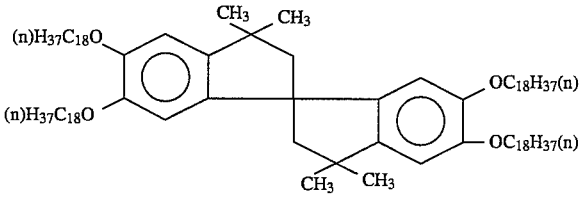
(I-i-23)
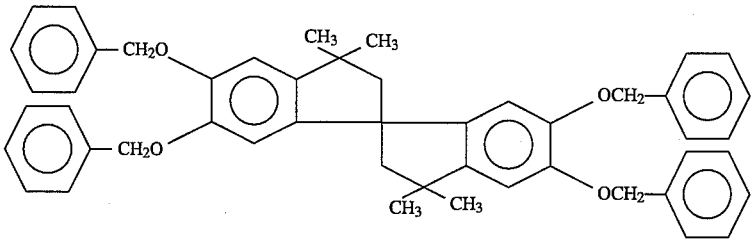

-continued

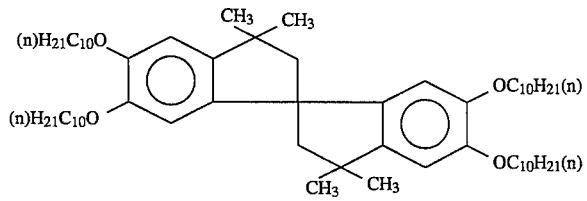

(I-i-24)

The above compounds can be prepared in a variety of ways such as those using the methods described in JP-A-45-14034, JP-A-56-24257, JP-A-59-52421, JP-A-55-89835, JP-A-56-159644, JP-A-62-244045, JP-A-62-244046, JP-A-62-273531, JP-A-63-220142, JP-A-63-95439, JP-A-63-95448, JP-A-63-95450 and European Patent 0,239,972, or variations of the aforementioned methods.

Any ultraviolet absorber can be used for the ultraviolet absorber which is used together with the water insoluble polymer and the compound represented by formula (I) or the compound represented by formula (I-i) according to the present invention. However, the use of thiazolidone, benzotriazole, acrylonitrile or benzophenone-based ultraviolet absorbers is preferred. Such ultraviolet absorbers have been disclosed in U.S. Pat. Nos. 1,023,859, 2,685,512, 2,739,888, 2,784,087, 2,748,021, 3,004,896, 3,052,636, 3,215,530, 3,253,921, 3,533,794, 3,692,525, 3,705,805, 3,707,375, 3,738,837 and 3,754,919, and in British Patent No. 1,321,355. The benzotriazole-based compounds are the more desirable, and the 2-(2'-hydroxyphenyl)benzotriazole based compounds represented by aforementioned general formula (II) are preferred. The compounds may be solids or liquids at normal temperature. Actual examples of liquids are disclosed in, for example, JP-B-55-36984, JP-B-55-12587 and JP-A-58-214152. Details of the atoms or groups represented by $R_7$, $R_8$, $R_9$, $R_{10}$ and $R_{11}$ of the ultraviolet absorbers represented by general formula (II) are disclosed in, for example, JP-A-58-221844, JP-A-59-46646, JP-A-59-109055, JP-B-36-10466, JP-B-42-26187, JP-B-48-5496, JP-B-48-41572, and U.S. Pat. Nos. 3,754,919 and 4,220,711.

Some actual examples of compounds represented by formulae (IIa) and (IIb), which are included among the compounds represented by formula (II) are described below. However, the invention should be construed as in any way limited to those examples.

TABLE Ia

General Formula (IIa)

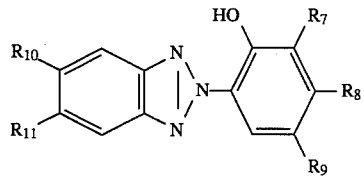

| UV No. | $R_{10}$ | $R_{11}$ | $R_7$ | $R_8$ | $R_9$ |
|---|---|---|---|---|---|
| 1 | H | H | H | H | H |
| 2 | H | H | H | H | $CH_3$ |
| 3 | H | H | H | H | $C_4H_9$(t) |
| 4 | H | H | H | H | $C_5H_{11}$(sec) |
| 5 | H | H | H | H | $C_5H_{11}$(t) |
| 6 | H | H | H | H | $C_6H_5$ |
| 7 | H | H | H | H | $C_6H_{11}$ |
| 8 | H | H | H | H | $C_8H_{17}$(n) |
| 9 | H | H | H | H | $C_8H_{17}$(i) |
| 10 | H | H | H | H | $C_8H_{17}$(t) |
| 11 | H | H | H | H | $C_{12}H_{25}$(n) |
| 12 | H | H | H | H | $C_{16}H_{33}$(n) |
| 13 | H | H | H | H | $OCH_3$ |
| 14 | H | H | H | H | $C_2H_4COOC_8H_{17}$ |
| 15 | H | H | H | H | $CONHC_{12}H_{25}$(n) |
| 16 | H | H | $CH_3$ | H | $C_4H_9$(sec) |
| 17 | H | H | $CH_3$ | H | $C_4H_9$(t) |
| 18 | H | H | $C_4H_9$(sec) | H | $C_4H_9$(sec) |
| 19 | H | H | $C_4H_9$(sec) | H | $C_4H_9$(t) |
| 20 | H | H | $C_4H_9$(t) | H | $C_4H_9$(sec) |
| 21 | H | H | $C_4H_9$(t) | H | $C_4H_9$(t) |
| 22 | H | H | $C_4H_9$(t) | H | $C_{12}H_{25}$(sec) |
| 23 | H | H | $C_4H_9$(t) | H | $C_2H_4COOC_8H_{17}$ |
| 24 | H | H | $C_5H_{11}$(t) | H | $C_5H_{11}$(t) |
| 25 | H | H | $C_5H_{11}$(t) | H | $C_6H_5$ |
| 26 | H | H | $C_5H_{11}$(t) | H | $CH_2C_6H_5$ |
| 27 | H | H | Cl | H | Cl |
| 28 | H | H | $CH_2NHCOOC_5H_{11}$(n) | H | H |
| 29 | H | Cl | H | H | $C_5H_{11}$(t) |
| 30 | H | Cl | H | H | $C_6H_5$ |

TABLE Ia-continued

General Formula (IIa)

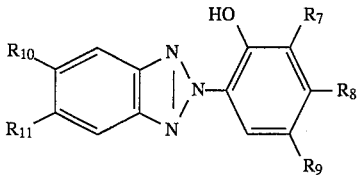

| UV No. | $R_{10}$ | $R_{11}$ | $R_7$ | $R_8$ | $R_9$ |
|---|---|---|---|---|---|
| 31 | H | Cl | H | H | $C_6H_{11}$ |
| 32 | H | Cl | H | H | $C_2H_4COOC_8H_{17}$ |
| 33 | H | Cl | H | H | Cl |
| 34 | H | Cl | $C_4H_9$(sec) | H | $C_4H_9$(sec) |
| 35 | H | Cl | $C_4H_9$(sec) | H | $C_4H_9$(t) |
| 36 | H | Cl | $C_4H_9$(t) | H | $CH_3$ |
| 37 | H | Cl | $C_4H_9$(t) | H | $CH_2CH{=}CH_2$ |
| 38 | H | Cl | $C_4H_9$(t) | H | $C_4H_9$(sec) |
| 39 | H | Cl | $C_4H_9$(t) | H | $C_4H_9$(t) |
| 40 | H | Cl | $C_4H_9$(t) | H | $C_6H_{11}$ |
| 41 | H | Cl | $C_4H_9$(t) | H | $C_2H_4COOC_8H_{17}$ |
| 42 | H | Cl | $C_5H_{11}$(n) | H | $C_6H_5$ |
| 43 | H | Cl | $CH_2N$(/$C_4H_9$(t)\$CH_3$) | H | H |
| 44 | H | $SO_2C_2H_5$ | $CH_3$ | H | $CH_3$ |
| 45 | H | $CH_3$ | H | H | $C_8H_{17}$(i) |
| 46 | H | $CH_3$ | H | H | $OCH_3$ |
| 47 | H | $CH_3$ | $C_4H_9$(sec) | H | $C_4H_9$(sec) |
| 48 | H | $CH_3$ | $C_4H$((sec) | H | $C_4H_9$(t) |
| 49 | H | $CH_3$ | $C_5H_{11}$(t) | H | $OC_6H_5$ |
| 50 | H | $CH_3$ | Cl | H | $C_8H_{17}$(n) |
| 51 | H | $C_2H_5$ | $C_3H_7$(i) | H | $C_3H_7$(i) |
| 52 | H | $C_4H_9$(n) | $C_4H_9$(sec) | H | $C_4H_9$(sec) |
| 53 | H | $C_4H_9$(n) | $C_4H_9$(sec) | H | $C_4H_9$(t) |
| 54 | H | $C_4H_9$(n) | $C_4H_9$(sec) | H | $C_5H_{11}$(t) |
| 55 | H | $C_4H_9$(sec) | $C_4H_9$(t) | H | $C_4H_9$(t) |
| 56 | H | $C_4H_9$(sec) | $C_4H_9$(t) | H | $C_5H_{11}$(t) |
| 57 | H | $C_4H_9$(sec) | $C_4H_9$(t) | H | $C_2H_4COOC_8H_{17}$ |
| 58 | H | $C_4H_9$(sec) | $C_5H_{11}$(t) | H | $C_5H_{11}$(t) |
| 59 | H | $C_4H_9$(t) | $C_4H_9$(sec) | H | $C_4H_9$(sec) |
| 60 | H | $C_4H_9$(t) | $C_4H_9$(sec) | H | $C_4H_9$(t) |
| 61 | H | $C_4H_9$(t) | $C_4H_9$(sec) | H | $C_5H_{11}$(t) |
| 62 | H | $C_4H_9$(t) | $C_4H_9$(t) | H | $C_4H_9$(t) |
| 63 | H | $C_5H_{11}$(n) | $C_4H_9$(sec) | H | $C_4H_9$(t) |
| 64 | H | $C_5H_{11}$(t) | $C_4H_9$(sec) | H | $C_4H_9$(t) |
| 65 | H | $C_6H_{5(t)}$ | $C_5H_{11}$(t) | H | $C_5H_{11}$(t) |
| 66 | H | $C_6H_5$ | $C_4H_9$(t) | H | $C_4H_9$(t) |
| 67 | H | $C_6H_5$ | $C_5H_{11}$(t) | H | $C_5H_{11}$(t) |
| 68 | H | $C_8H_{17}$(n) | H | H | $C_8H_{17}$(i) |
| 69 | H | OH | $C_4H_9$(t) | H | $C_4H_9$(t) |
| 70 | H | $OCH_3$ | H | H | $OC_8H_{17}$(sec) |
| 71 | H | $OCH_3$ | $C_4H_9$(sec) | H | $C_4H_9$(sec) |
| 72 | H | $OCH_3$ | $C_4H_9$(sec) | H | $C_4H_9$(t) |
| 73 | H | $OCH_3$ | $C_5H_{11}$(t) | H | $C_5H_{11}$(t) |
| 74 | H | $OCH_3$ | $C_5H_{11}$(t) | H | $C_6H_5$ |
| 75 | H | $OCH_3$ | Cl | H | Cl |
| 76 | H | $OC_2H_5$ | $C_4H_9$(sec) | H | $C_4H_9$(t) |
| 77 | H | $OC_4H_9$(n) | Cl | H | $OCH_3$ |
| 78 | H | $OC_6H_5$ | $C_5H_{11}$(t) | H | $C_5H_{11}$(t) |
| 79 | H | $COOC_4H_9$(n) | $C_4H_9$(n) | H | $C_5H_{11}$(t) |
| 80 | H | $NO_2$ | $C_8H_{17}$(n) | H | $OCH_3$ |
| 81 | H | H | H | Cl | Cl |
| 82 | H | H | H | $OC_8H_{17}$ | H |
| 83 | H | $CH_3$ | H | $CH_3$ | $CH_3$ |
| 84 | H | Cl | H | $C_{15}H_{31}$ | H |
| 85 | $CH_3$ | $OC_4H_9$(n) | H | H | H |
| 86 | $CH_3$ | $OC_9H_{19}$(n) | H | H | H |
| 87 | $CH_3$ | $OC_{12}H_{25}$(n) | H | H | H |
| 88 | Cl | Cl | H | H | H |
| 89 | $OCH(CH_3)_2$ | $OCH(CH_3)_2$ | H | H | H |
| 90 | $OCH(CH_3)_2$ | $OCH(CH_3)_2$ | H | H | $CH_3$ |

TABLE Ia-continued

General Formula (IIa)

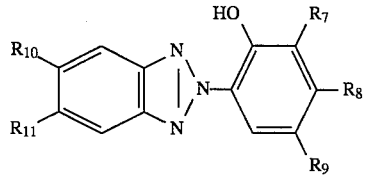

| UV No. | $R_{10}$ | $R_{11}$ | $R_7$ | $R_8$ | $R_9$ |
|---|---|---|---|---|---|
| 91 | $OCH(CH_3)_2$ | $OC_2H_3(CH_3)_2$ | H | H | H |
| 92 | $OC_4H_9(n)$ | $OC_4H_9(n)$ | H | H | H |
| 93 | $OC_4H_9(n)$ | $OC_4H_9(n)$ | H | H | $OCH_3$ |

TABLE Ib

General Formula (IIb)

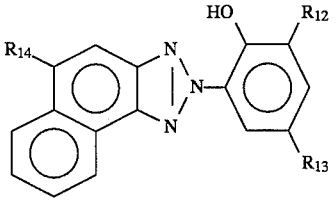

(IIb)

| | $R_{14}$ | $R_{12}$ | $R_{13}$ |
|---|---|---|---|
| 94 | H | H | $CH_3$ |
| 95 | H | H | $C_8H_{17}$ |
| 96 | H | $C_4H_9(t)$ | $C_4H_9(t)$ |
| 97 | Cl | H | $C_2H_5$ |

According to the present invention, the ultraviolet absorber is included in a silver halide emulsion layer and/or non-photosensitive layer of the color photographic material. However, it is most desirably included in the photosensitive layer which is furthest from the support, and the non-photosensitive layer above that photosensitive layer (a non-photosensitive layer on the opposite side from the support).

The ultraviolet absorbers and compounds represented by formulae (I) or (I-i) are preferably introduced into the photographic sensitive material in the form of emulsified dispersions.

The total coated weight of ultraviolet absorber is preferably from 0.1 to 10.0 g/m$^2$, and most preferably from 0.1 to 5.0 g/m$^2$.

The polymer is preferably used in an amount of from 0.05 to 5.00 grams, and most preferably in an amount of from 0.5 to 1.00 gram, per gram of ultraviolet absorber.

The compound represented by general formula (I) is used preferably in an amount of from 0.01 to 1.00 gram, and most desirably in an amount of from 0.01 to 0.5 gram, per gram of ultraviolet absorber.

When a compound of general formula (I-i) is used, it is preferably used in the aforementioned quantities, and it is most preferably used in amounts of from 0.05 to 0.5 gram per gram, of ultraviolet absorber.

Emulsified dispersions of ultraviolet absorbers, water insoluble polymers and compounds represented by the general formula (I), or of ultraviolet absorbers and compounds of general formula (I-i), may or may not include a high boiling point organic solvent. In those cases where a high boiling point organic solvent is used, any solvent which does not impede photographic performance may be used.

Compounds having melting points below 100° C. and boiling points above 140° C., which are immiscible with water, are preferred as high boiling point organic solvents. They may be solids or liquids at room temperature. High boiling point organic solvents which have melting points of not more than 80° C., and boiling points of at least 160° C., preferably at least 170° C., are most preferred.

Typical examples of high boiling point organic solvents are indicated below, but these solvents should not be construed as limiting the invention.

O-1

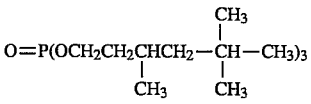

O-2

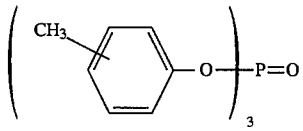

O-3

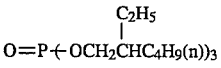

O-4

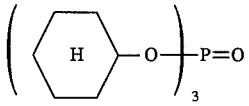

O-5

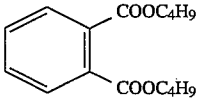

O-6

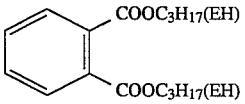

Note: $C_8H_{17}EH$ signifies $-CH_2CHC_4H_9$.
$C_2H_5$

O-7

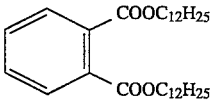

-continued

O-8

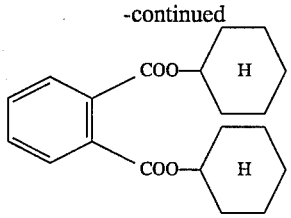

O-9

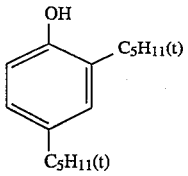

O-10

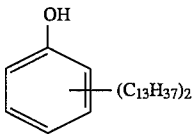

O-11

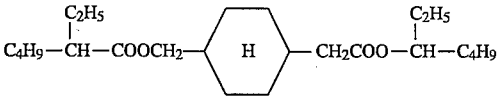

O-12

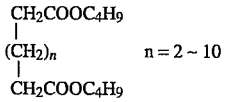

O-13

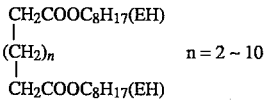

O-14

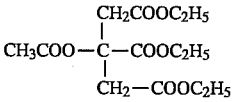

O-15

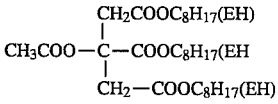

O-16

$C_{13}H_{27}COOC_{18}H_{37}$(iso)

O-17

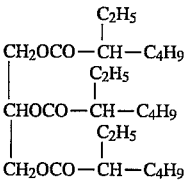

O-18

$C_{11}H_{23}CON(C_2H_5)_2$

O-19

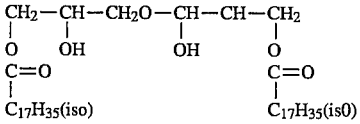

O-20

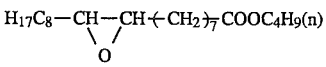

-continued

O-21

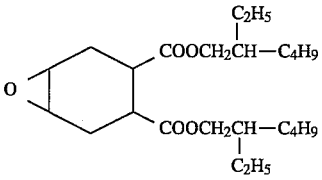

O-22

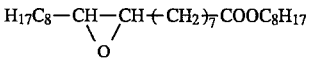

O-23

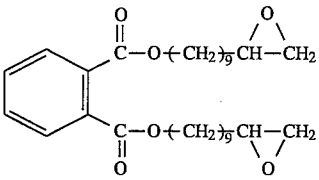

Dispersions of lipophilic particles which contain an ultraviolet absorber, a high boiling point organic solvent and a compound of formula (I-i) can be prepared in the following way.

A compound of formula (I-i) and a high boiling point organic solvent are dissolved completely together with an auxiliary solvent, and then the solution is dispersed in the form of fine particles in water, preferably an aqueous hydrophilic colloid solution or most preferably an aqueous gelatin solution with the aid of a dispersing agent by a suitable means such as ultrasonics, a colloid mill or a high speed agitator. Alternatively, water or an aqueous hydrophilic colloid solution such as an aqueous gelatin solution, is added to an auxiliary organic solvent which contains a dispersing agent such as a surfactant, a high boiling point organic solvent and an ultraviolet absorber. Then an oil-in-water dispersion is made by phase reversal. The aforementioned dispersion methods may be adopted after removing the auxiliary organic solvent from the dispersion which has been prepared, using a method such as distillation, noodle washing, ultrafiltration or reduced pressure degassing.

British Patent 2,016,017A describes one method useful for the preparation of a dispersion of fine lipophilic particles which contain ultraviolet absorber, polymer and compound represented by general formula (I) according to the present invention. But, the method of emulsification and dispersion disclosed in JP-A-63-264748 is preferred. That is, a polymer useful in the present invention (a so-called "linear polymer") prepared without crosslinking by solution polymerization, emulsion polymerization or suspension polymerization, a compound represented by general formula (I), and an ultraviolet absorber, are dissolved completely in an auxiliary organic solvent and the resulting solution is dispersed in water, preferably in an aqueous hydrophilic colloid solution, and most preferably in an aqueous gelatin solution with the aid of a dispersing agent to form fine particles ultrasonically, in a colloid mill or by using a high speed agitator. Alternatively, water or an aqueous hydrophilic colloid solution, such as an aqueous gelatin solution, is added to an auxiliary solvent which contains the polymer, a compound represented by formula (I) and an ultraviolet absorber, and then an oil in water dispersion may be obtained by phase reversal. The aforementioned dispersion procedure may be used after removing the auxiliary organic solvent from the dispersion obtained by distillation, noddle washing, ultra-filtration or reduced pressure degassing.

The auxiliary organic solvent is an organic solvent which is useful during emulsification and dispersion and which can be ultimately removed from the photosensitive material during the drying process, at the time of coating, or by means of the methods described above. Also, it should be a low boiling point organic solvent or a solvent which has a certain solubility in water and which can be removed by washing with water. Examples of suitable auxiliary solvents include lower alcohol acetates such as ethyl acetate and butyl acetate, ethyl propionate, secondary butyl alcohol, methyl ethyl ketone, methyl isobutyl ketone, β-ethoxyethyl acetate, methylcellosolve acetate and cyclohexanone.

Moreover, organic solvents which are completely miscible with water, such as methyl alcohol, ethyl alcohol, acetone and tetrahydrofuran, can be used in part conjointly, as required.

Furthermore, combinations of two or more of the above organic solvents can be used. The average particle size of the fine lipophilic particles obtained in this manner is preferably from 0.04 μm to 2 μm and more desirably from 0.04 μm to 0.4 μm. They are most desirably from 0.04 μm to 0.12 μm. The particle size of the fine lipophilic particles can be measured using an apparatus such as the nanosizer made by the British Coulter Tar Co.

Various photographically useful hydrophobic substances can be included in the fine lipophilic particles. Examples of such photographically useful lipophilic substances include color or non-color couplers, developing agents. developing agent precursors, development inhibitor precursors, development accelerators, gradation control agents such as hydroquinones, dyes, dye releasing agents, antioxidants, fluorescent whiteners, and anti-fading agents. Furthermore, these lipophilic substances may be used together conjointly.

Silver chloride, silver bromide, silver (iodochlorobromide and silver iodobromide, for example, can be used as the silver halide in the present invention. However, the use of silver chlorobromide emulsions which contain at least 90 mol %, preferably at least 95 mol % and most preferably at least 98 mol % of silver chloride, or silver chloride emulsions, which contain essentially no silver iodide is .preferred particularly to obtain rapid processing.

Dyes which can be decolorized by processing (including oxonol dyes) such as those disclosed on pages 27 to 76 of European Patent No. 0,337,490A2, can be added to the hydrophilic colloid layer of a photosensitive material according to the present invention in such a way that the optical reflection density at 680 nm of the sensitive material is at least 0.70. And, the addition of at least 12 wt %, preferably at least 14 wt %, of titanium oxide, the surface of which, has been treated with a di-hydric-tetra-hydric alcohol such as trimethylolethane to the water resistant resin layer of the support is desirable to improve image sharpness.

Furthermore, the use of colored image stability improving compounds such as those disclosed in European Patent No. 0,277,589A2, together with the couplers, is desirable. Conjoint use with pyrazoloazole couplers is especially desirable. That is, the independent or simultaneous use of compounds (F) which bind chemically with a primary aromatic amine based developing agent which remains after color development processing and forms a compound which is chemically inert and essentially colorless and/or a compound (G) which binds chemically with the oxidized form of a primary aromatic amine based color developing agent which remains after color development processing and forms a compound which is chemically inert and essentially colorless, is desirable. It can prevent staining or other side effects due to colored dye formation resulting from reactions between couplers and the color developer or oxidation products thereof which remain in the film on storage after processing.

Furthermore, the addition of biocides such as those disclosed in JP-A-63-271247 to a photosensitive material according to the present invention is desirable for preventing the growth of the various microorganisms and fungi which can propagate in the hydrophilic colloid layers and cause the image to deteriorate.

Furthermore, a white polyester based support for display purposes, or a support on which a layer which contains a white pigment has been established on the side where the silver halide layer is to be located, may be used as the support. Moreover, the establishment by coating of an anti-halation layer on the side of the support on which the silver halide layer is to be coated, or on the reverse side, is preferred for improving sharpness. The establishment of a support transmission density in the range from 0.35 to 0.8 is especially preferred so that the display can be viewed by both reflected light and transmitted light.

A photosensitive material according to the present invention may be exposed using visible light or using infrared light. Low luminance exposures and high luminance short time exposures may be used for making the exposure, and in the latter case in particular, a laser scanning exposure system with an exposure time shorter than $10^{-4}$ second per picture element is desirable.

Furthermore, use of the band strip filters such as those disclosed in U.S. Pat. No. 4,880,726 during exposure is desirable. Mixed color light can be eliminated and color reproduction can be markedly improved.

The exposed photosensitive material is preferably subjected to a bleach-fixing process after color development for rapid processing. In cases where the aforementioned high silver chloride emulsions have been used, the pH of the bleach-fix bath is preferably below about 6.4, and most preferably below about 6 for accelerating the de-silvering process.

Useful silver halide emulsions and other elements (additives etc.), photographic structural layers (layer arrangements etc.) and methods of processing which can be used to process the materials, and additives which can be used for processing, have been disclosed in the patent documents indicated below. Those disclosed in European Patent No. 0,355,660A2 (Japanese Patent Application No. 1-107011) are especially preferable.

| Photographic Structural Element | JP-A-62-215272 | JP-A-2-33144 | EP 0,355,660A2 |
|---|---|---|---|
| Silver Halide Emulsions | Upper hand column 10, line 6 to lower left column page 12, line 5, and Lower right column page 12, fourth line | Upper right column on page 28, line 16 to lower right column on page 29, line 11, and page 30, lines 2 to 5. | Page 45 line 53 to page 47 line 3, and page 47 lines 20 to 22 |

-continued

| Photographic Structural Element | JP-A-62-215272 | JP-A-2-33144 | EP 0,355,660A2 |
|---|---|---|---|
| | from the bottom to upper left column page 13, line 17 | | |
| Silver Halide Solvents | Lower left column on page 12, lines 6 to 14, and upper left column on page 13, line 3 from the bottom to lower left column on page 18, last line | — | — |
| Chemical Sensitizers | Page 12, lower left column line 3 from the bottom to lower right column line 5 from the bottom and lower right column on page 18, line 1 to upper right column on page 22, line 9 from the bottom | Lower right column on page 29 line 12 to the last line. | Page 47, lines 4 to 9 |
| Spectral Sensitizers (Methods of Spectral Sensitization) | Upper right column on page 22, line 8 from the bottom to last line on page 38 | Upper left column on page 30, lines 1 to 13. | Page 47, lines 10 to 15 |
| Emulsion Stabilizers | Upper left column on page 39, line 1 to upper right column on page 72, last line | Upper left column on page 30, line 14 to upper right column on page 30, line 1 | Page 47, lines 16 to 19 |
| Development Accelerators | Lower left column on page 72, line 1 to upper right column on page 91, line 3 | — | — |
| Color Couplers (Cyan, Magenta, and Yellow Couplers) | Upper right column on page 91, line 4 to upper left column on page 121, line 6 | Upper right column on page 3, line 14 to upper left column on page 18, last line and upper right column on page 30, line 6 to lower right column on page 35, line 11 | Page 4, lines 15 to 27, page 5 line 30 to the lest line on page 28, page 45 lines 29 to 31 and page 47, line 23 to page 63, line 50 |
| Super-sensitizers | Upper left column on page 121, line 7 to upper right column on page 125, line 1 | — | — |
| Ultraviolet Absorbers | Upper right column on page 125, line 2 to lower left column on page 127, last line | Lower right column on page 37, line 14 to upper left column on page 38, line 11 | Page 62, lines 22 to 31 |
| Anti-fading Agents (Image Stabilizers) | Lower right column on page 127, line 1 to lower left column on page 137, line 8 | Upper right column on page 36, line 12 to upper left column on page 37, line 19 | Page 4 line 30 to page 5 line 23, page 29 line 1 to page 45 line 25, page 45 lines 33 to 40, page 65 lines 2 to 21 |
| High Boiling Point and/or Low Boiling Point Organic Solvents | Lower left column on page 137, line 9 to upper right column on page 44, last Line | Lower right column on page 35, line 14 to upper left column on page 36, line 4 from the bottom | Page 64, lines 1 to 51 |
| Method for the Dispersion of Photographic Useful Additives | Lower left column on page 144, line 1 to upper right column on page 146, line 7 | Lower right column on page 27, line 10 to upper left column on page 28, last line and lower right column on page 35, line 12 to upper right column, page 36, line 7 | Page 63 line 51 to page 64 line 56 |
| Film Harden-ing Agents | Upper right column on page 146, line 8 to lower left column on page 155, line 4 | — | — |
| Developing Agent Precursors | Lower left column on page 155, line 5 to lower right column on page 155, line 2 | — | — |
| Development Inhibitor Releasing Compounds | Lower left column on page 155, lines 3 to 9 | — | — |
| Supports | Lower right column on page 155, line 19 to upper left column on page 156, line 14 | Upper right column on page 38, line 18 to upper left column on page 39, line 8 | Page 66, line 29 to page 67, line 13 |
| Sensitive Material Layer | Upper left column on page 156, line 15 to lower right column on page 156, line 14 | Upper right column on page 28, lines 1 to 15 | Page 45, lines 41 to 52 |

-continued

| Photographic Structural Element | JP-A-62-215272 | JP-A-2-33144 | EP 0,355,660A2 |
|---|---|---|---|
| Structure | | | |
| Dyes | Lower right column on page 156, line 15 to lower right column on page 184, last line | Upper left column on page 38, line 12 to upper right column on page 38, line 7 | Page 66, lines 18 to 22 |
| Anti-color Mixing Agents | Upper left column on page 185, line 1 to lower right column on page 188, line 3 | Upper right column on page 36, lines 8 to 11 | Page 64 line 57 to page 65 line 1 |
| Gradation Control Agents | Lower right column on page 188, lines 4 to 8 | — | — |
| Anti-staining Agents | Lower right column on page 188, line 9 to lower right column on page 193, line 10 | Upper left column on page 37, last line to lower right column on page 37, line 13 | Page 65 line 32 to page 66 line 17 |
| Surfactants | Lower left column on page 201, line 1 to upper right column on page 210, last line | Upper right column on page 18, line 1 to lower right column on page 24, last line and lower left column on page 27, line 10 from the bottom to lower right column on page 27, line 9 | — |
| Fluorine-Containing Compounds (Anti-static agents, coating promoters, lubricants, and anti-static agents etc.) | Lower left column on page 210, line 1 to lower left column on page 222, line 5 | Upper left column on page 25, line 1 to lower right column on page 27, line 9 | — |
| Binders (Hydrophilic colloids) | Lower left column on page 222, line 6 to upper left column on page 225, last line | Upper right column on page 38, lines 8 to 18 | Page 66, lines 23 to 28 |
| Thickeners | Upper right column on page 225, line 1 to upper right column on page 230, line 2 | — | — |
| Anti-static Agents | Upper right column on page 227, line 3 to upper left column on page 230 line 1 | — | — |
| Polymer Latexes | Upper left column on page 230, line 2 to page 239, last line | — | — |
| Matting Agents | Upper left column on page 240, line 1 to upper right column on page 240, last line | — | — |
| Photographic Processing Methods (Processing operations and additives etc.) | Upper right column on page 3, line 7 to upper right column on page 10, line 5 | Upper left column on page 39, line 4 to upper left column on page 42, last line | Page 67, line 14 to page 69, line 28 |

NOTES
The citations from JP-A-62-215272 also include the details amended in accordance with the procedural amendment dated 16th March 1987 which is appended to the end of the specification. Furthermore, from among the color couplers referred to above, the use of the so-called short wave type yellow couplers disclosed in JP-A-63-231451, JP-A-63-123047, JP-A-63-241547, JP-A-1-173499, JP-A-1-213648 and JP-A-1-250944 for the yellow coupler is preferred.

Furthermore, in addition to diphenylimidazole based cyan couplers such as those disclosed in JP-A-2-33144, 3-hydroxypyridine based cyan couplers such as those disclosed in European Patent No. 0,333,185A2 (of which the coupler obtained by providing the four-equivalent coupler (42) cited as an illustrative example with a chlorine leaving group to provide a two-equivalent coupler, and couplers (6) and (9) are particularly preferred), and cyclic active methylene based cyan couplers such as those disclosed in JP-A-64-32260 (of which couplers 3, 8 and 34 cited as actual examples are preferred), as cyan couplers is also desirable.

With a silver halide photographic material according to the present invention it is possible by using small amounts of additives to obtain excellent photographic materials in which the ultraviolet absorber has excellent fastness to light and in which the light fastness of the dye image is improved; without adverse effects on photographic properties and without incurring problems in terms of manufacture.

The invention is further described below using illustrative examples. However, the examples are not intended to limit the invention in any way.

EXAMPLE 1

The first and second layers described below were were coated on a transparent cellulose triacetate support.

First Layer 10 grams of the ultraviolet absorber shown in Table 2, 5 grams of high boiling point organic solvent and 8 ml of ethyl acetate were heated to 60° C. to form a complete solution. 90 grams of 15% aqueous gelatin solution and 6 ml of sodium dodecylbenzenesulfonate (10% aqueous solution) were then added to the solution, and the mixture was emulsified in a homogenizer (made by Nippon Seiki). An aqueous gelatin solution was added to the resulting liquid, and this was applied as coating in the coated weights indicated below. 1-Oxy-3,5-dichloro-s-triazine, sodium salt, was used as a hardening agent.

| Coated Weights | |
|---|---|
| Ultraviolet absorber | 0.20 g/m$^2$ |
| High boiling point organic solvent | 0.08 g/m$^2$ |
| Gelatin | 0.96 g/m$^2$ |

Second Layer 10 grams of a ten percent aqueous gelatin solution, 100 ml of water and 3 ml of 10% Alkanol-X (made by the DuPont Co.) as a coating promotor, were mixed and applied as a coating in the coated weights indicated below.

| Coated Weights | |
|---|---|
| Gelatin | 2.75 g/m$^2$ |

The above coated material was prepared as sample 1.

Samples 2 to 30 were prepared in the same manner as Sample 1 except that the composition of the first layer was changed as indicated in Table 2. That is, according to the present invention the polymers and compounds of formula (I) were dissolved in ethyl acetate along with the ultraviolet absorber, and the resulting mixtures were emulsified and dispersed.

Next, Sample 2 to 31 was prepared in the same manner as Sample 1, except that compound I-3 was dissolved in ethyl acetate and added to the second layer in such a way that the coated weight was 0.03 g/m$^2$. And, the composition of the first layer was changed as indicated in Table 2. The ultraviolet absorption densities of the samples was measured by transmission and the value of the density at the absorption peak was noted. In those cases where there were two peaks the value of the longer wavelength peak was noted.

The samples were then exposed for 25 days at 100,000 lux in a xenon fadometer. The ultraviolet absorbance was measured again, and the values of the densities of the absorption peaks at the same wavelengths were noted as before.

The ratio of the density after exposure relative to the density before exposure was determined to investigate the survival rate of the ultraviolet absorbers.

$$\text{Survival Rate} = \frac{\text{Density After Exposure}}{\text{Density Before Exposure}} \times 100(\%)$$

The results obtained are set forth in Table 2.

Furthermore, the average particle size of the first layer emulsion of each sample was measured using a nanosizer made by the British Coulter Tar Co. The results are also set forth in Table 2.

TABLE 2

| Sample No. | Ultraviolet Absorber (Ratio by weight) | Type of Polymer (Amount added, gm$^2$) | Compound of General Formula [I] (Amount added, g/m$^2$) | High boiling point organic solvent | Oil Droplet Particle Size (μm) | Survival Rate (%) | Remarks |
|---|---|---|---|---|---|---|---|
| 1 | UV-2/UV-24/UV-39 (2/1/6) | / | / | 0-1 | 0.09 | 49 | Comparative Example |
| 2 | UV-2/UV-24/UV-39 (2/1/6) | / | I-3 (0.01) | " | 0.09 | 50 | Comparative Example |
| 3 | UV-2/UV-24/UV-39 (2/1/6) | / | I-3 (0.03) | " | 0.09 | 50 | Comparative Example |
| 4 | UV-2/UV-24/UV-39 (2/1/6) | / | I-3 (0.05) | " | 0.09 | 51 | Comparative Example |
| 5 | UV-2/UV-24/UV-39 (2/1/6) | / | I-3 (0.10) | " | 0.10 | 53 | Comparative Example |
| 6 | UV-2/UV-24/UV-39 (2/1/6) | P-4 (0.10) | / | " | 0.09 | 55 | Comparative Example |
| 7 | UV-2/UV-24/UV-39 (2/1/6) | P-4 (0.20) | / | " | 0.15 | 60 | Comparative Example |
| 8 | UV-2/UV-24/UV-39 (2/1/6) | P-4 (0.40) | / | " | 0.37 | 68 | Comparative Example |
| 9 | UV-2/UV-24/UV-39 (2/1/6) | P-4 (0.20) | I-3 (0.10) | " | 0.16 | 83 | This Invention |
| 10 | UV-2/UV-24/UV-39 (2/1/6) | P-4 (0.10) | I-3 (0.01) | " | 0.09 | 76 | This Invention |
| 11 | UV-2/UV-24/UV-39 (2/1/6) | P-4 (0.10) | I-3 (0.03) | 0-1 | 0.10 | 79 | Comparative Example |
| 12 | UV-2/UV-24/UV-39 | P-4 | I-3 | " | 0.10 | 80 | Comparative |

TABLE 2-continued

| Sample No. | Ultraviolet Absorber (Ratio by weight) | Type of Polymer (Amount added, $gm^2$) | Compound of General Formula [I] (Amount added, $g/m^2$) | High boiling point organic solvent | Oil Droplet Particle Size (μm) | Survival Rate (%) | Remarks |
|---|---|---|---|---|---|---|---|
| | (2/1/6) | (0.10) | (0.06) | | | | Example |
| 13 | UV-2/UV-24/UV-39 (2/1/6) | P-4 (0.10) | I-3 (0.10) | " | 0.11 | 82 | Comparative Example |
| 14 | UV-11/UV-41/UV-95 (3/7/1) | P-21 (0.10) | / | — | 0.09 | 56 | Comparative Example |
| 15 | UV-11/UV-41/UV-95 (3/7/1) | P-21 (0.10) | I-18 (0.03) | — | 0.11 | 78 | This Invention |
| 16 | UV-11/UV-41/UV-95 (3/7/1) | P-23 (0.10) | " (0.03) | — | 0.10 | 76 | This Invention |
| 17 | UV-11/UV-41/UV-95 (3/7/1) | P-57 (0.10) | " (0.03) | — | 0.10 | 79 | This Invention |
| 18 | UV-11/UV-41/UV-95 (3/7/1) | P-62 (0.10) | " (0.03) | — | 0.11 | 79 | This Invention |
| 19 | UV-11/UV-41/UV-95 (3/7/1) | P-68 (0.10) | " (0.03) | — | 0.10 | 82 | This Invention |
| 20 | UV-11/UV-41/UV-95 (3/7/1) | P-68 (0.10) | I-40 (0.03) | — | 0.11 | 78 | This Invention |
| 21 | UV-11/UV-41/UV-95 (3/7/1) | P-68 (0.10) | I-46 (0.03) | — | 0.10 | 79 | This Invention |
| 22 | UV-19/UV-73 (1/1) | P-57 (0.10) | / | 0-2 | 0.09 | 52 | Comparative Example |
| 23 | UV-19/UV-73 (1/1) | P-57 (0.10) | I-8 (0.03) | " | 0.09 | 76 | This Invention |
| 24 | UV-24/UV-82 (2/3) | P-62 (0.10) | / | " | 0.10 | 49 | Comparative Example |
| 25 | UV-24/UV-82 (2/3) | P-62 (0.10) | I-43 (0.03) | — | 0.10 | 78 | This Invention |
| 26 | UV-11/UV-41 (3/6) | P-57 (0.10) | / | — | 0.10 | 59 | Comparative Example |
| 27 | UV-11/UV-41 (3/6) | P-57 (0.10) | I-3 (0.03) | — | 0.11 | 83 | This Invention |
| 28 | UV-11/UV-41 (3/6) | P-62 (0.10) | / | — | 0.10 | 57 | Comparative Example |
| 29 | UV-11/UV-41 (3/6) | P-62 (0.10) | I-10 (0.03) | — | 0.11 | 79 | This Invention |
| 30 | UV-11/UV-41 (3/6) | P-80 (0.10) | I-3 (0.03) | — | 0.10 | 77 | This Invention |
| 31 | UV-11/UV-41 (3/6) | / | / | / | 0.09 | 53 | Comparative Example |

As may be seen from comparative Sample 2 to 4 in Table 2, there is no improvement in light fastness of the ultraviolet absorber itself when the compound of general formula (I) is added alone, without the conjoint use of the polymer. Furthermore, although there is a slight improving effect on increasing the amount of polymer which is added in the range shown in Table 2 for comparative samples 6 to 8, the effect is not of the level achieved with the method of this present invention.

According to the present invention where compound of general formula (I) and a polymer are used conjointly, there is an improvement which could not have been anticipated from past results in terms of light fastness of the ultraviolet absorber itself without impairment of the coated material.

EXAMPLE 2

A multi-layer color printing paper A-1 having the layer structure indicated below was prepared by establishing a gelatin under-layer, which contained sodium dodecylbenzenesulfonate, on the surface of a paper support. The support had been laminated on both sides with polyethylene which had been subjected to a corona discharge treatment. Thereafter coating contained of the various photographic structural layers.

The coating materials were prepared in the manner described below.

Preparation of the First Layer Coating Liquid

Ethyl acetate (27.2 cc) and 4.1 grams each of solvent (Solv-3) and solvent (Solv-7) were added to 19.1 grams of yellow coupler (ExY) and 4.4 grams of colored image stabilizer (Cpd-1) to form a solution which was then emulsified and dispersed in 185 cc of a 10% aqueous gelatin solution which contained 8 cc of 10% sodium dodecylbenzenesulfonate to provide emulsified dispersion A. Also, silver chlorobromide emulsion A was prepared; a 3:7 (Ag mol ratio) mixture of a large size cubic emulsion of average grain size 0.88 μm and a small size cubic emulsion A of average grain size 0.70 μm with the variation coefficients of the grain size distributions being 0.08 and 0.10, and each size emulsion having 0.3 mol % silver bromide included locally on part of the grain surface. The blue sensitive sensitizing dyes A and B indicated below were added in amounts of $2.0\times10^{-4}$ mol of each per mol of silver in the emulsion which had large grains, and in amounts of $2.5\times10^{-4}$ mol of each per mol of silver halide in the emulsion which had small grains. Furthermore, chemical ripening of the emulsion was carried out with the addition of a sulfur sensitizing agent and a gold sensitizing agent. This silver chlorobromide emulsion A was mixed with the aforementioned emulsified dispersion A to prepare the first layer coating liquid, the composition of which is indicated below.

The coating liquids for the second to the seventh layers were prepared using the same procedure as for the first layer coating liquid. 1-Oxy-3,5-dichloro-s-triazine, sodium salt, was used as a gelatin hardening agent in each layer.

Furthermore, Cpd-7 and Cpd-8 were each added to each layer in such a way as to provide a total amount of 25.0 mg/m$^2$ and 50 mg/m$^2$ respectively.

The spectrally sensitizing dyes indicated below were used in the silver chlorobromide emulsion of each photosensitive emulsion layer.

Blue Sensitive Emulsion Layer: Sensitizing Dye A

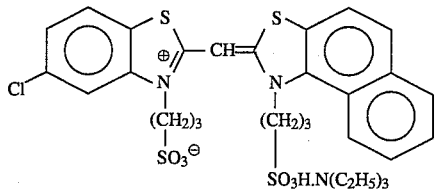

Blue Sensitive Emulsion Layer: Sensitizing Dye B

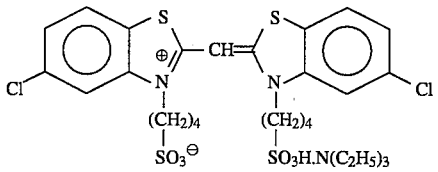

This was added in an amount of $2.0\times10^{-4}$ mol of each per mol of silver halide in the large size emulsion A, and $2.5\times10^{-4}$ mol of each per mol of silver halide in the small size emulsion A.

Green Sensitive Emulsion Layer: Sensitizing Dye C

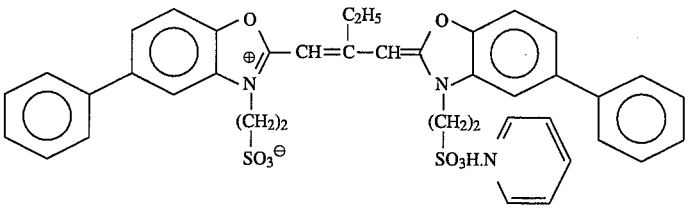

This was added in an amount of $4.0\times10^{-4}$ mol per mol of silver halide in the large size emulsion B, and $5.6\times10^{-4}$ mol per mol of silver halide in the small size emulsion B.

Green Sensitive Emulsion Layer: Sensitizing Dye D

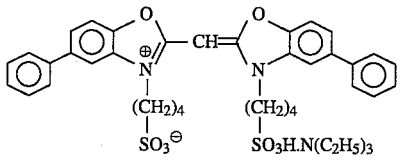

This was added in an amount of $7.0\times10^{-5}$ mol per mol of silver halide in the large size emulsion B, and $1.0\times10^{-5}$ mol per mol of silver halide in the small size emulsion B.

Red Sensitive Emulsion Layer: Sensitizing Dye E

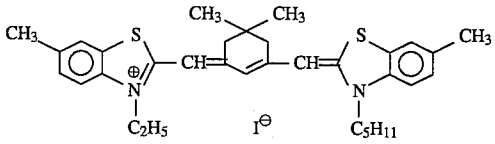

This was added in an amount of $0.9\times10^{-4}$ mol per mol of silver halide in the large size emulsion C, and $1.1\times10^{-4}$ mol per mol of silver halide in the small size emulsion C.

The compound indicated below was added in an amount of $2.6\times10^{-3}$ mol per mol of silver halide to the red sensitive emulsion layer.

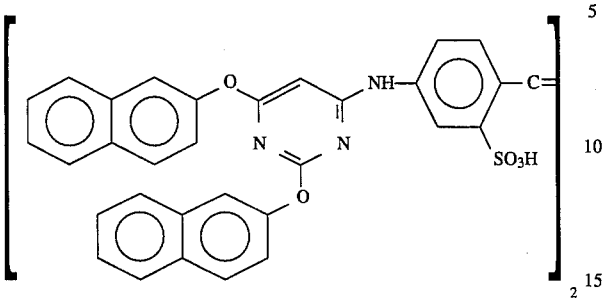

Furthermore, 1-(5-methylureidophenyl)-5-mercaptotetrazole was added to the blue, green and red sensitive emulsions layers in amounts, per mol of silver halide, of $8.5\times10^{-5}$ mol, $7.7\times10^{-4}$ mol and $2.5\times10^{-4}$ mol respectively.

Furthermore, 4-hydroxy-6-methyl-1,3,3a,7-tetraazaindene was added to the blue and green sensitive emulsion layers in amounts, per mol of silver halide, of $1\times10^{-4}$ mol and $2\times10^{-4}$ mol respectively.

The dyes indicated below (with the coated weights shown in brackets) were added to the emulsion layers for anti-irradiation purposes.

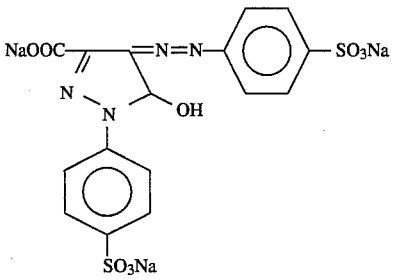

(10 mg/m²)

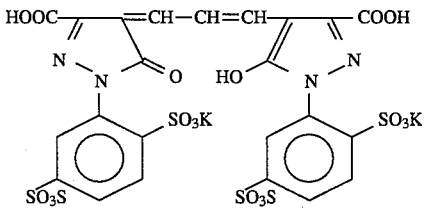

(10 mg/m²)

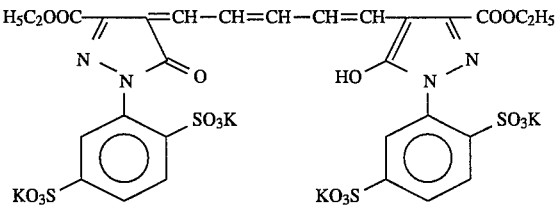

(40 mg/m²)

and

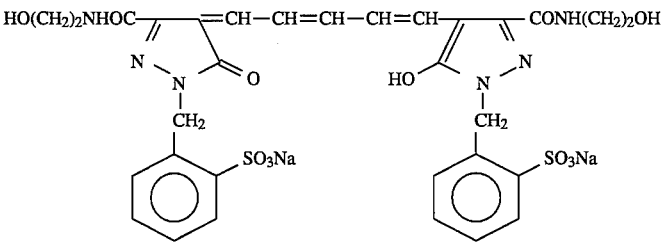

(20 mg/m²)

Layer Structure

The composition of each layer is indicated below. The numerical values indicate coated weights ($g/m^2$). In the case of silver halide emulsions the coated weight is shown as the calculated coated weight of silver.

Support

Polyethylene laminated paper (Titanium oxide ($TiO_2$) and blue dye (ultramarine) were included in the polyethylene on the first layer side)

| | |
|---|---|
| First Layer (Blue Sensitive Emulsion Layer) | |
| The aforementioned silver chlorobromide emulsion A | 0.30 |
| Gelatin | 1.86 |
| Yellow coupler (ExY) | 0.82 |
| Colored image stabilizer (Cpd-1) | 0.19 |
| Solvent (Solv-3) | 0.18 |
| Solvent (Solv-7) | 0.18 |
| Second Layer (Anti-color Mixing Layer) | |
| Gelatin | 0.99 |
| Anti-color mixing agent (Cpd-4) | 0.08 |
| Solvent (Solv-1) | 0.16 |
| Solvent (Solv-4) | 0.08 |
| Third Layer (Green Sensitive Emulsion Layer) | |
| Silver chlorobromide emulsion (a 1:3 (silver mol ratio) mixture of the large size cubic emulsion B of average grain size 0.55 μm and the small size cubic emulsion B of average grain size 0.39 μm; the variation coefficients of the grain size distributions being 0.10 and 0.08, and each emulsion had 0.8 mol % AgBr included locally on part of the grain surface) | 0.12 |
| Gelatin | 1.24 |
| Magenta coupler (ExM) | 0.23 |

-continued

| | |
|---|---|
| Colored image stabilizer (Cpd-2) | 0.03 |
| Colored image stabilizer (Cpd-3) | 0.02 |
| Colored image stabilizer (Cpd-6) | 0.02 |
| Solvent (Solv-2) | 0.40 |
| Fourth Layer (Ultraviolet Absorbing Layer) | |
| Gelatin | 1.58 |
| Ultraviolet absorber | 0.50 |
| Anti-color mixing agent (Cpd-4) | 0.05 |
| Solvent (Solv-5) | 0.24 |
| Fifth Layer (Red Sensitive Emulsion Layer) | |
| Silver chlorobromide emulsion (a 1:4 (silver mol ratio) mixture of the large size cubic emulsion C of average grain size 0.58 μm and the small size cubic emulsion C of average grain size 0.45 μm; the variation coefficients of the grain size distributions being 0.09 and 0.11, and each emulsion had 0.6 mol % AgBr included locally on part of the grain surfaces) | 0.23 |
| Gelatin | 1.34 |
| Cyan coupler (ExC) | 0.32 |
| Colored image stabilizer (Cpd-2) | 0.03 |
| Colored image stabilizer (Cpd-3) | 0.02 |
| Ultraviolet absorber | 0.18 |
| Colored image stabilizer (Cpd-5) | 0.05 |
| Solvent (Solv-6) | 0.14 |
| Sixth Layer (Ultraviolet Absorbing Layer) | |
| Gelatin | 0.53 |
| Ultraviolet absorber | 0.20 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

(ExY) Yellow Coupler:

A 1:1 (mol ratio) mixture of

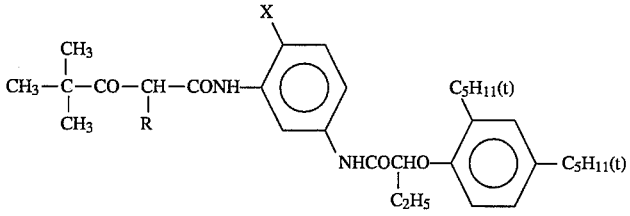

R =

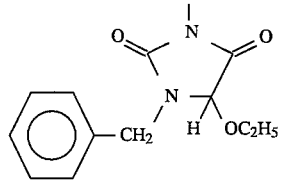

X = Cl and

-continued
R = 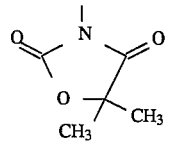 X = $OCH_3$
(ExM) Magenta Coupler:
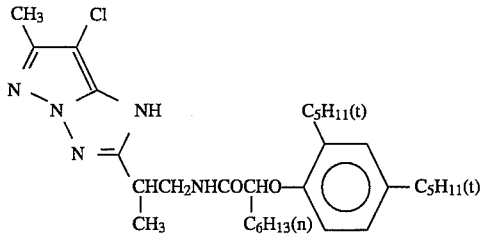
(ExC) Cyan Coupler:
A 1:1 (mol ratio) mixture of :
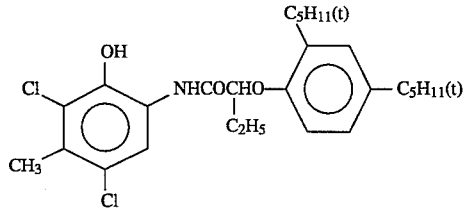
and
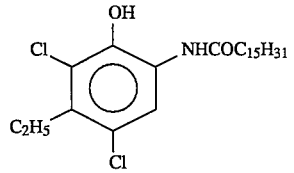
(Cpd-1) Color Image Stabilizer:
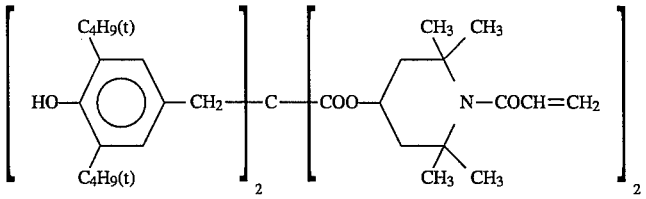
(Cpd-2) Color Image Stabilizer:
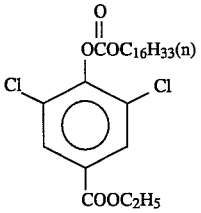
(Cpd-3) Colored Image Stabilizer -continued
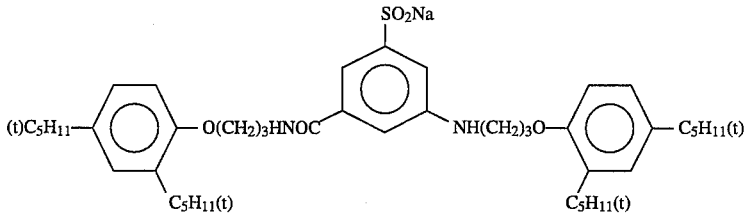
(Cpd-4) Anti-color Mixing Agent:
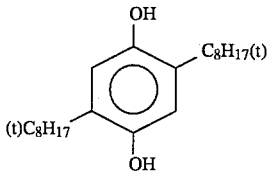
(Cpd-5) Colored Image Stabilizer:
A 1:1 (by weight) mixture of
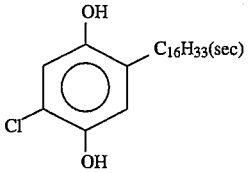
and
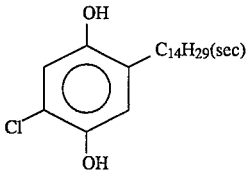
(Cpd-6) Colored Image Stabilizer:
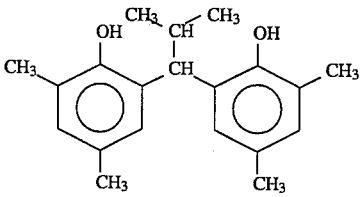
(Cpd-7) Fungicide
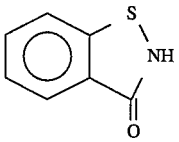
(Cpd-8) Fungicide
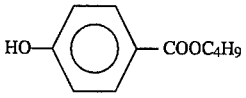
(Solv-1) Solvent:
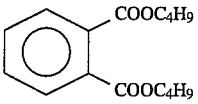
(Solv-2) Solvent:
A 1:1 (by volume) mixture of:
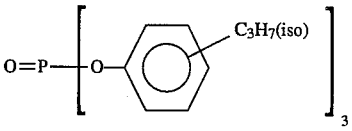

-continued and

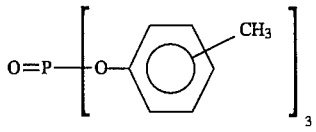

(Solv-3) Solvent:

$O{=}P{-}[O{-}C_9H_{19}(iso)]_3$ (Solv-4) Solvent:

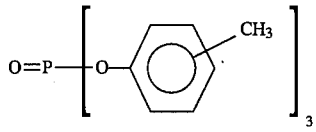

(Solv-5) Solvent $(COOC_8H_{17})_2(CH_2)_8$ (Solv-6) Solvent

An 80:20 (by volume) mixture of

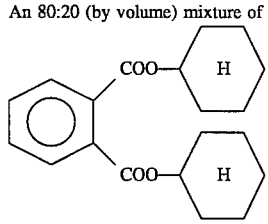

and $C_8H_{17}CHCH(CH_2)_7COOC_8H_{17}$ (O)

(Solv-7) Solvent $C_8H_{17}CHCH(CH_2)_7COOC_8H_{17}$ (O)

Samples (A-2) to (A-27) were prepared by changing the compositions of the fourth layer (ultraviolet absorbing layer), the fifth layer (red sensitive emulsion layer) and the sixth layer (ultraviolet absorbing layer) of Sample (A-1) in the ways indicated in Table 3. Furthermore, for those samples, the emulsion layers of which the method of this present invention was adopted, were prepared by dissolving the ultraviolet absorber, the polymer, and the compound of formula (I), together with the other additives, in ethyl acetate, and emulsifying and dispersing the resulting solution in an aqueous gelatin solution.

Furthermore, the average particle size of the resulting emulsions was measured using a nanosizer made by the British Coal Tar Co.. In all cases, it was within the range from 0.06 to 0.12μ.

Each sample was subjected to graded exposure with tri-color separation filters for sensitometric purposes using a sensitometer (model FWH, made by the Fuji Photo Film Co., Ltd., light source color temperature 3200° K.). The exposure at this time was 250 CMS with an exposure time of 0.1 second.

The exposed samples were processed in a paper processor continuously (in a running test) using the processing operations and processing baths described below until the system had been replenished to the extent of twice the color development tank capacity.

| Processing Operation | Temperature (°C.) | Time (sec.) | Replenishment Rate* | Tank Capacity |
|---|---|---|---|---|
| Color Development | 35 | 45 | 161 ml | 17 liters |

-continued

| | | | | |
|---|---|---|---|---|
| Bleach-fix | 30–35 | 45 | 215 ml | 17 liters |
| Rinse (1) | 30–35 | 20 | — | 10 liters |
| Rinse (2) | 30–35 | 20 | — | 10 liters |
| Rinse (3) | 30–35 | 20 | 350 ml | 10 liters |
| Drying | 70–80 | 60 | | |

*Replenishment rate per square meter of photosensitive material.
(A three tank counter flow system from rinse (3) → Rinse (1) was used)

The composition of each processing bath is set forth below.

| Color Development Bath | Tank Solution | Replenisher |
|---|---|---|
| Water | 800 ml | 800 ml |
| Ethylenediamine-N,N,N',N'-tetramethylenephosphonic acid | 1.5 grams | 2.0 grams |
| Potassium bromide | 0.015 gram | — |
| Triethanolamine | 8.0 grams | 12.0 grams |
| Sodium chloride | 1.4 grams | |
| Potassium carbonate | 25 grams | 25 grams |
| N-Ethyl-N-(β-methanesulfonamidoethyl)-3-methyl-4-aminoaniline sulfate | 5.0 grams | 7.0 grams |
| N,N-Bis(carboxymethyl) hydrazine | 4.0 grams | 5.0 grams |
| N,N-di(sulfoethyl)hydroxylamine monosodium salt | 4.0 grams | 5.0 grams |
| Fluorescent whitener (WHITEX 4B, made by Sumitomo Chemicals) | 1.0 gram | 2.0 grams |
| Water to make up to | 1000 ml | 1000 ml |
| pH (25° C.) | 10.05 | 10.45 |

-continued

Bleach-fix Bath (Tank Solution = Replenisher)

| | |
|---|---|
| Water | 400 ml |
| Ammonium thiosulfate (700 g/l) | 100 ml |
| Sodium sulfite | 17 grams |
| Ethylenediamine tetra-acetic acid, iron(III) ammonium salt, di-hydrate | 55 grams |
| hylenediamine tetra-acetic acid, disodium salt | 5 grams |
| Ammonium bromide | 40 grams |
| Water to make up to | 1000 ml |
| pH (25° C.) | 6.0 |

Rinse Bath (Tank Solution=Replenisher)

Ion exchange water (Calcium and magnesium both less than 3 ppm)

The samples so obtained were subjected to fading tests in a xenon fadometer (100,000 Lux) for 20 days, and their light fastness was evaluated in terms of survival rates (%) for the .yellow (Y), magenta (M) and cyan (C) dye images obtained at an initial density of 2.00. The results obtained are set forth in Table 3.

Moreover, the amounts of the polymers and compounds of formula (I) which were added were 0.5 gram and 0.1 gram, respectively, per 1.0 gram of ultraviolet absorber.

TABLE 3

| Sample No. | Ultraviolet Absorber (Weight Ratio) | Polymer Type | Compound of General Formula [I] | Layers Which Contain a Polymer and the Compound Noted on the Left | Survival Rate (%) Y | M | C | Remarks |
|---|---|---|---|---|---|---|---|---|
| A-1 | UV11/UV39/UV41 (3/1/7) | / | / | / | 52 | 54 | 56 | Comparative Example |
| A-2 | UV11/UV39/UV41 (3/1/7) | / | I-3 | 4, 6 | 53 | 54 | 56 | Comparative Example |
| A-3 | UV11/UV39/UV41 (3/1/7) | P-4 | / | " | 6 2 | 61 | 60 | Comparative Example |
| A-4 | UV11/UV39/UV41 (3/1/7) | " | I-3 | " | 77 | 78 | 74 | This Invention |
| A-5 | UV11/UV39/UV41 (3/1/7) | " | " | 4, 5, 6 | 79 | 79 | 78 | This Invention |
| A-6 | UV11/UV39/UV41 (3/1/7) | " | I-18 | 4, 6 | 79 | 78 | 75 | This Invention |
| A-7 | UV11/UV39/UV41 (3/1/7) | " | " | 4, 5, 6 | 79 | 79 | 78 | This Invention |
| A-8 | UV11/UV39/UV41 (3/1/7) | P-21 | " | " | 78 | 77 | 75 | This Invention |
| A-9 | UV11/UV39/UV41 (3/1/7) | P-23 | " | " | 77 | 77 | 75 | This Invention |
| A-10 | UV11/UV39/UV41 (3/1/7) | P-57 | " | " | 78 | 78 | 76 | This Invention |
| A-11 | UV11/UV39/UV41 (3/1/7) | P-62 | I-18 | 4, 5, 6 | 78 | 78 | 77 | Comparative Example |
| A-12 | UV11/UV39/UV41 (3/1/7) | P-68 | " | " | 79 | 78 | 79 | Comparative Example |
| A-13 | UV11/UV39/UV41 (3/1/7) | " | I-3 | " | 78 | 77 | 78 | Comparative Example |
| A-14 | UV11/UV39/UV41 (3/1/7) | " | I-8 | " | 76 | 75 | 75 | Comparative Example |
| A-15 | UV11/UV39/UV41 (3/1/7) | " | I-40 | " | 76 | 76 | 75 | Comparative Example |
| A-16 | UV11/UV39/UV41 (3/1/7) | " | I-46 | " | 77 | 76 | 76 | Comparative Example |
| A-17 | UV2/UV24/UV39 | / | / | / | 53 | 54 | 52 | Comparative |

TABLE 3-continued

| Sample No. | Ultraviolet Absorber (Weight Ratio) | Polymer Type | Compound of General Formula [I] | Layers Which Contain a Polymer and the Compound Noted on the Left | Survival Rate (%) Y | M | C | Remarks |
|---|---|---|---|---|---|---|---|---|
| | (2/1/6) | | | | | | | Example |
| A-18 | UV2/UV24/UV39 (2/1/6) | / | I-3 | 4, 5, 6 | 53 | 53 | 53 | Comparative Example |
| A-19 | UV2/UV24/UV39 (2/1/6) | P-21 | / | " | 60 | 62 | 59 | Comparative Example |
| A-20 | UV2/UV24/UV39 (2/1/6) | " | I-3 | " | 76 | 79 | 78 | This Invention |
| A-21 | UV2/UV24/UV39 (2/1/6) | P-80 | I-3 | 4, 5, 6 | 75 | 78 | 78 | This Invention |
| A-22 | UV11/UV41/UV95 (3/7/1) | / | I-18 | 4, 5, 6 | 53 | 55 | 55 | Comparative Example |
| A-23 | UV11/UV41/UV95 (3/7/1) | P-68 | / | " | 62 | 61 | 63 | Comparative Example |
| A-24 | UV11/UV41/UV95 (3/7/1) | " | I-18 | " | 79 | 80 | 80 | This Invention |
| A-25 | UV11/UV41/UV95 (3/7/1) | " | I-40 | " | 78 | 79 | 80 | This Invention |
| A-26 | UV19/UV73 | P-62 | / | " | 58 | 59 | 59 | Comparative Example |
| A-27 | UV19/UV73 | / | I-40 | " | 75 | 77 | 77 | Comparative Example |

As may be seen from the results in Table 3, the multi-layer color photosensitive materials of this present invention are such that, in comparison to the comparative example, there was an improvement with respect of fading due to light of the colored images which had been formed from each coupler, and a good balance between the various dye images was retained even on long term exposure.

EXAMPLE 3

Samples 32–61, samples where the coated weights of ultraviolet absorber and high boiling point organic solvent were the same as with Sample 1, were prepared in the same way as Sample 1 of Example 1 except that the composition of the first layer in the method of Example 1 was changed in the ways indicated in Table 4. A compound of formula (I) was dissolved, along with the ultraviolet absorber, in ethyl acetate. Thus, the resulting solution was emulsified and dispersed. The ultraviolet spectral absorption densities of the samples were measured by transmission; the value of the absorption at the absorption peak was noted; and the survival rates were obtained in the same way as described in Example 1.

The results obtained are set forth in Table 4.

TABLE 4

| Sample No. | Ultraviolet Absorber (weight ratio) | High Boiling Point Organic Solvent | Compound of General Formula (I-i) ($g/m^2$) | Survival Rate (%) | Remarks |
|---|---|---|---|---|---|
| 32 | UV-19/UV-24/UV-39 (10/12/3) | O-2 | — | 66 | Comparative Example |
| 33 | UV-19/UV-24/UV-39 (10/12/3) | O-6 | — | 65 | Comparative Example |
| 34 | UV-19/UV-24/UV-39 (10/12/3) | O-13 | — | 67 | Comparative Example |
| 35 | UV-19/UV-24/UV-39 (10/12/3) | O-22** | — | 65 | Comparative Example |
| 36 | UV-19/UV-24/UV-39 (10/12/3) | O-2 | I-i-I (0.05) | 75 | This Invention |
| 37 | UV-19/UV-24/UV-39 (10/12/3) | O-6 | " | 74 | This Invention |
| 38 | UV-19/UV-24/UV-39 (10/12/3) | O-13 | " | 77 | This Invention |
| 39 | UV-19/UV-24/UV-39 (10/12/3) | O-22** | " | 79 | This Invention |
| 40 | UV-19/UV-24/UV-39 (10/12/3) | O-2 | I-i-21 (0.05) | 74 | This Invention |
| 41 | UV-19/UV-24/UV-39 (10/12/3) | " | I-i-21 (0.10) | 76 | This Invention |
| 42 | UV-19/UV-24/UV-39 (10/12/3) | " | I-i-21 (0.15) | 80 | This Invention |
| 43 | UV-19/UV-24/UV-39 (10/12/3) | O-13 | I-i-1 (0.05) | 78 | This Invention |

TABLE 4-continued

| Sample No. | Ultraviolet Absorber (weight ratio) | High Boiling Point Organic Solvent | Compound of General Formula (I-i) ($g/m^2$) | Survival Rate (%) | Remarks |
|---|---|---|---|---|---|
| 44 | UV-19/UV-24/UV-39 (10/12/3) | " | I-i-7 (0.05) | 74 | This Invention |
| 45 | UV-19/UV-24/UV-39 (10/12/3) | " | I-i-18 (0.05) | 75 | This Invention |
| 46 | UV-19/UV-24/UV-39 (10/12/3) | O-2 | I-i-21 (0.05) | 76 | This Invention |
| 47 | UV-19/UV-24/UV-39 (10/12/3) | — | I-i-7 (0.05) | 75 | This Invention |
| 48 | UV-19/UV-24/UV-39 (10/12/3) | — | I-i-21 (0.05) | 75 | This Invention |
| 49 | UV-3/UV-24/UV-41 (1/3/2) | O-2 | — | 68 | Comparative Example |
| 50 | UV-3/UV-24/UV-41 (1/3/2) | " | I-i-1 (0.05) | 78 | This Invention |
| 51 | UV-11/UV-19/UV-22 (2/1/3) | " | — | 64 | Comparative Example |
| 52 | UV-11/UV-19/UV-22 (2/1/3) | " | I-i-7 (0.05) | 73 | This Invention |
| 53 | UV-3/UV-11/UV-41 (2/1/1) | — | — | 68 | Comparative Example |
| 54 | UV-3/UV-11/UV-41 (2/1/1) | — | I-i-21 (0.05) | 76 | This Invention |
| 55 | UV-a*/UV-b* (2/3) | O-13 | — | 62 | Comparative Example |
| 56 | UV-a*/UV-b* (2/3) | O-13 | I-i-1 (0.05) | 67 | This Invention |
| 57 | UV-a*/UV-b* (2/3) | — | — | 63 | Comparative Example |
| 58 | UV-a*/UV-b* (2/3) | — | I-i-1 (0.05) | 69 | This Invention |
| 59 | UV-19/UV-41/UV-71 (1/1/2) | O-2 | — | 66 | Comparative Example |
| 60 | UV-19/UV-41/UV-71 (1/1/2) | " | I-i-21 (0.05) | 78 | This Invention |
| 61 | UV-19/UV-41/UV-71 | — | " | 78 | This Invention |

*UV-a:

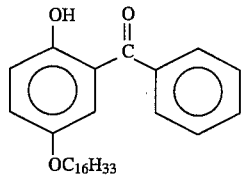

UV-b:

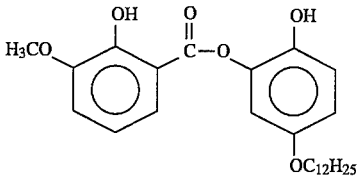

**The O-22 used was of n = 6.

As may be seen from the results set forth in Table 4, light fastness of the ultraviolet absorber itself is markedly improved by the co-presence of the ultraviolet absorber and compounds of formula (I) according to the present invention.

EXAMPLE 4

A multi-layer color paper Sample a, was prepared in the same way described in Example 2. The first layer coating liquid was prepared in the same way as described in Example 2, except that 0.7 gram of (Cpd-10) was added instead of the 4.4 grams of (Cpd-1), as a colored image stabilizer in the emulsified dispersion A. The coating liquids for the second to the seventh layers were prepared in the same way as described in Example 2 for the first layer. In the fifth layer, the cyan coupler and the colored image stabilizer (Cpd-10) etc. were dissolved in ethyl acetate and then emulsified and dispersed. The spectrally sensitizing dyes and the amounts of these dyes added to the silver chlorobromide emulsions of each photosensitive emulsion layer were the same as in Example 2.

Layer Composition

The composition of each layer was the same as in Example 2, except for the components indicated below.

First Layer (Blue Sensitive Emulsion Layer)

Colored image stabilizer (Cpd-10) added in an amount of 0.60 $g/m^2$

Third Layer (Green Sensitive Emulsion Layer)

The illustrative compounds shown in Table 5 were added in amounts of 0.16 $g/m^2$

Fourth Layer (Ultraviolet Absorbing Layer)

(1) Ultraviolet absorber (UV-6/UV-7/UV-10=3/4/1) was used in an amount of 0.47 $g/m^2$ instead of the 0.50 $g/m^2$ of ultraviolet absorber.

(2) The illustrative compounds shown in Table 5 were added in amounts of 0.06 g/m$^2$.

Fifth Layer (Red Sensitive Emulsion Layer)

(1) The colored image stabilizer (Cpd-9) was used in an amount of 0.18 g/m$^2$ instead of the 0.18 g/m$^2$ of ultraviolet absorber.

(2) The colored image stabilizer (Cpd-10) was added in an amount of 0.40 g/m$^2$.

Sixth Layer (Ultraviolet Absorbing Layer)

(1) Ultraviolet absorber (UV-17/UV-22/UV-36=3/4/1) was used in an amount of 0.16 g/m$^2$ instead of the 0.20 g/m$^2$ of ultraviolet absorber.

(2) The illustrative compounds shown in Table 5 were added in amounts of 0.20 g/m$^2$.

(3) The organic solvents shown in Table 5 were used in amounts of 0.08 g/m$^2$.

(Cpd-9) Colored Image Stabilizer

A 2:2:4 (by weight) mixture of:

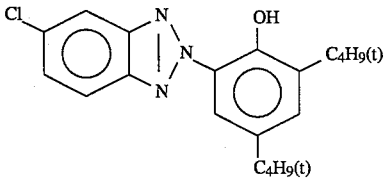

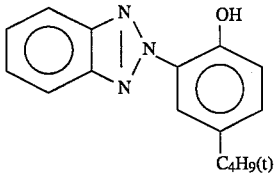

and

-continued

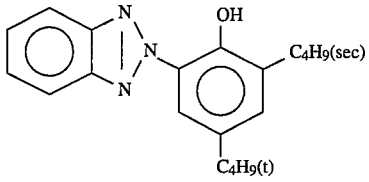

(Cpd-10) Colored Image Stabilizer

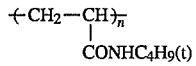

(Average Molecular Weight 60,000)

Next, Samples b–z were prepared using the same method as for Sample a by changing the compositions of the third layer (green sensitive layer), the fourth layer (ultraviolet absorbing layer) and the sixth layer (ultraviolet absorbing layer) of Sample a as shown in Table 5

Next, the samples obtained in this way were exposed using the same procedure as described in Example 2, after which they were processed continuously using a paper processor under the same conditions as in Example 2.

The samples obtained in this way were subjected to a light resistance test. The degree of light resistance was expressed in terms of the ratio (%) of dye image density before and after the light resistance test. The conditions of the light resistance test were such that the value of the density at the same position as that which had a density before the test of 1.80 was noted after exposure for 14 days in a xenon fadometer at 100,000 lux.

The ratio of the density after exposure with respect to that before exposure was noted for each dye to investigate light resistance. The results obtained are set forth in Table 5.

TABLE 5

| Sample No. | Ultraviolet Absorber (weight ratio) | High Boiling Point Organic Solvent in the Sixth Layer | Illustrative Compound in the Third/ Fourth and Sixth Layers | Light Resistance Yellow | Magenta | Cyan | Remarks |
|---|---|---|---|---|---|---|---|
| a | UV-19/UV-24/UV-39 (3/4/1) | Solv-1 | — — | 60 | 58 | 60 | Comparative Example |
| b | UV-19/UV-24/UV-39 (3/4/1) | Solv-2 | —/— | 59 | 57 | 60 | Comparative Example |
| c | UV-19/UV-24/UV-39 (3/4/1) | Solv-5 | —/— | 59 | 57 | 59 | Comparative Example |
| d | UV-19/UV-24/UV-39 (3/4/1) | Solv-6 | —/— | 57 | 56 | 59 | Comparative Example |
| e | UV-19/UV-24/UV-39 (3/4/1) | Solv-1 | I-i-1/— | 60 | 62 | 60 | Comparative Example |
| f | UV-19/UV-24/UV-39 (3/4/1) | Solv-5 | I-i-1/— | 60 | 60 | 59 | Comparative Example |
| g | UV-19/UV-24/UV-39 (3/4/1) | Solv-1 | I-i-1/I-i-1 | 69 | 73 | 75 | This Invention |
| h | UV-19/UV-24/UV-39 (3/4/1) | Solv-2 | " | 69 | 72 | 74 | This Invention |
| i | UV-19/UV-24/UV-39 (3/4/1) | Solv-5 | " | 72 | 69 | 72 | This Invention |
| j | UV-19/UV-24/UV-39 (3/4/1) | Solv-6 | " | 68 | 68 | 70 | This Invention |
| k | UV-19/UV-24/UV-39 (3/4/1) | " | I-i-2/I-i-2 | 70 | 71 | 73 | This Invention |

TABLE 5-continued

| Sample No. | Ultraviolet Absorber (weight ratio) | High Boiling Point Organic Solvent in the Sixth Layer | Illustrative Compound in the Third/ Fourth and Sixth Layers | Light Resistance Yellow | Magenta | Cyan | Remarks |
|---|---|---|---|---|---|---|---|
| l | UV-19/UV-24/UV-39 (3/4/1) | " | I-i-1/I-i-18 | 72 | 71 | 74 | This Invention |
| m | UV-19/UV-24/UV-39 (3/4/1) | " | I-i-21/I-i-21 | 75 | 73 | 75 | This Invention |
| n | UV-19/UV-24/UV-39 (3/4/1) | — | —/— | 60 | 58 | 60 | Comparative Example |
| o | UV-19/UV-24/UV-39 (3/4/1) | — | I-i-21/I-i-23 | 75 | 74 | 75 | This Invention |
| p | UV-14/UV-32/UV-41 (2/1/3) | Solv-2 | —/— | 61 | 61 | 63 | Comparative Example |
| q | UV-14/UV-32/UV-41 (2/1/3) | " | I-i-2/— | 61 | 63 | 63 | Comparative Example |
| r | UV-14/UV-32/UV-41 (2/1/3) | Solv-2 | I-i-2/I-i-2 | 70 | 72 | 74 | This Invention |
| s | UV-11/UV-29/UV-73 (1/2/1) | " | —/— | 60 | 59 | 62 | Comparative Example |
| t | UV-11/UV-29/UV-73 (1/2/1) | " | I-i-21/I-i-23 | 73 | 71 | 73 | This Invention |
| u | UV-11/UV-29/UV-73 (1/2/1) | — | I-i-21/I-i-23 | 73 | 72 | 75 | This Invention |
| v | UV-22/UV-37/UV-60 (3/4/2) | Solv-5 | —/— | 58 | 57 | 59 | Comparative Example |
| w | UV-22/UV-37/UV-60 (3/4/2) | Solv-5 | I-i-21/I-i-18 | 70 | 70 | 72 | This Invention |
| x | UV-22/UV-37/UV-60 (3/4/1) | " | —/I-i-18 | 70 | 68 | 71 | This Invention |
| y | UV-22/UV-37/UV-60 (3/4/2) | — | I-i-21/— | 59 | 59 | 59 | Comparative Example |
| z | UV-22/UV-37/UV-60 (3/4/2) | — | I-i-21/I-i-18 | 71 | 72 | 72 | This Invention |

As may be seen from the results set forth in Table 5, the multi-layer color photosensitive materials of this present invention had markedly improved light fastness of each of the cyan, magenta and yellow dye images which were formed from each coupler.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one photosensitive silver halide emulsion layer and at least one non-photosensitive hydrophilic colloid layer, wherein a non-photosensitive hydrophilic colloid layer comprises a dispersion of an emulsified and dispersed mixed solution of 0.1 to 10 g/m$^2$ of at least one ultraviolet absorber of formula (II) below, 0.05 to 5 grams per gram of ultraviolet absorber of a homopolymer or copolymer which is insoluble in water but soluble in organic solvents and which includes a vinyl polymer having a —CO— bond or a phenyl group in the repeating unit, and 0.01 to 1 gram per gram of ultraviolet absorber of at least one compound represented by formula (I) below:

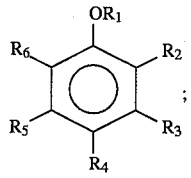

(I)

wherein $R_1$ represents an alkyl group, an alkenyl group, an aryl group, a heterocyclic group, a silyl group, an acyl group or a sulfonyl group, and $R_2$, $R_3$, $R_4$, $R_5$ and $R_6$, which may be identical or different, each represents a hydrogen atom, an alkyl group, an alkenyl group, an aryl group, a substituted amino group, an alkylthio group, an arylthio group, a halogen atom, $$-\overset{\overset{\displaystyle O}{\|}}{C}-OR_{1a} \quad \text{or} \quad -OR_{1a}$$

where $R_{1a}$ represents an alkyl group, an alkenyl, an aryl group, a heterocyclic group, a silyl group, an acyl group or a sulfonyl group, and wherein $R_1$ and $R_2$, $R_2$ and $R_3$, or $R_3$ and $R_4$ may be joined together to form a five or six membered ring or a spiro ring:

(II)

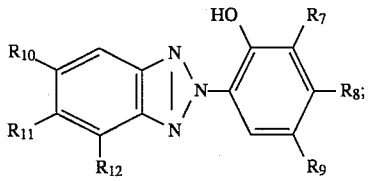

wherein $R_7$, $R_8$, $R_9$, $R_{10}$, $R_{11}$ and $R_{12}$ may be the same or different, and each represents a hydrogen atom, a halogen atom, a nitro group, a hydroxy group, an alkyl group, an alkoxy group, an aryl group, an aryloxy group, an acylamino group, a carbamoyl group or q sulfo group, and wherein $R_{11}$ and $R_{12}$ may be joined together to form a six membered ring.

2. A silver halide color photographic material according to claim 1, wherein the compound represented by formula (I) is a compound represented by one of the following formulae:

(I-a)

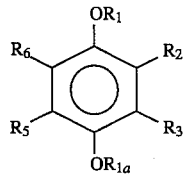

(I-b)

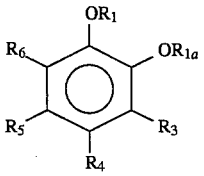

(I-c)

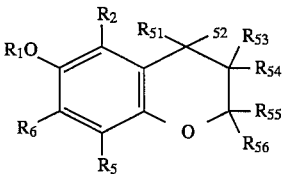

(I-d)

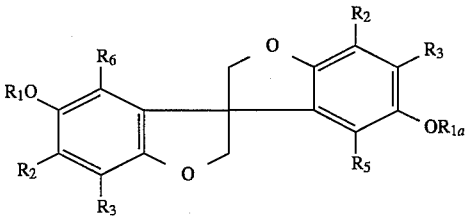

(I-e)

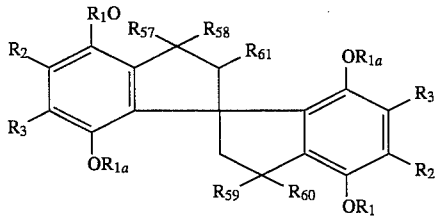

-continued (I-f)

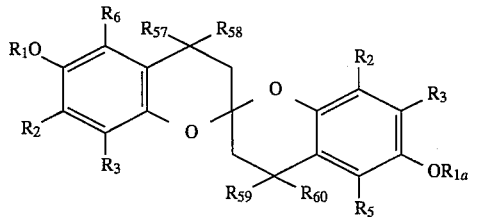

(I-g)

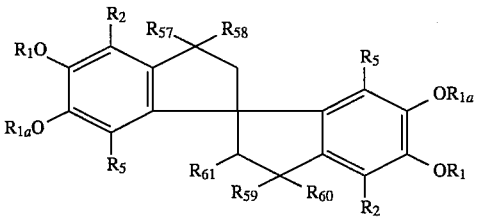

and wherein $R_1$, $R_{1a}$, $R_2$, $R_3$, $R_4$, $R_5$, and $R_6$ each has the same meaning as those defined for formula (I), and $R_{51}$, $R_{52}$, $R_{53}$, $R_{54}$, $R_{55}$, $R_{56}$, $R_{57}$, $R_{58}$, $R_{59}$, $R_{60}$, $R_{61}$, which may be the same or different, each represent a hydrogen atom, an alkyl group or an aryl group, wherein $R_{54}$ and $R_{55}$ and $R_{55}$ and $R_{56}$, may be joined together to form a five, six or seven membered hydrocarbyl ring.

3. A silver halide color photographic material according to claim 2, wherein $R_{51}$, $R_{52}$, $R_{53}$, $R_{54}$, $R_{55}$, $R_{56}$, $R_{57}$, $R_{58}$, $R_{59}$, $R_{60}$ and $R_{61}$, which may be the same or different, each represents a hydrogen atom, a methyl, ethyl, isopropyl, dodecyl, phenyl or p-methoxyphenyl group, and $R_{62}$ and $R_{63}$, which may be the same or different, each represents a hydrogen atom, a methyl, ethyl, dodecyl, phenyl, 4-chlorophenyl, acetyl, benzoyl, dodecanoyl, methoxycarbonyl, 4-dodecyloxy phenoxycarbonyl, methanesulfonyl, octanesulfonyl or benzenesulfonyl group.

4. A silver halide color photographic material according to claim 2, where $R_{62}$ and $R_{63}$ are joined together to form a morpholine or piperidine ring.

5. A silver halide color photographic material according to claim 2, wherein the compound represented by formula (I) is represented by formula (I-g).

6. A silver halide color photographic material according to claim 1, wherein at least one photosensitive silver halide emulsion layer and at least one non-photosensitive hydrophilic colloid layer each contains in the same layer a combination of at least one water insoluble homopolymer or copolymer, at least one compound represented by formula (I), and at least one ultraviolet absorber.

* * * * *

UNITED STATES PATENT AND TRADEMARK OFFICE

CERTIFICATE OF CORRECTION

PATENT NO. : 5,474,882

DATED : December 12, 1995

INVENTOR(S) : Akiko SHONO

It is certified that error appears in the above-indentified patent and that said Letters Patent is hereby corrected as shown below:

On the title page, item [30], delete "2-327613" and insert -- 2-324613 --.

Signed and Sealed this

Fifth Day of March, 1996

Bruce Lehman

*Attest:*

BRUCE LEHMAN

*Attesting Officer*

*Commissioner of Patents and Trademarks*